US010890198B2

(12) United States Patent
Mazin

(10) Patent No.: US 10,890,198 B2
(45) Date of Patent: Jan. 12, 2021

(54) LINEAR ACTUATOR

(71) Applicant: Ben Mazin, Goleta, CA (US)

(72) Inventor: Ben Mazin, Goleta, CA (US)

( * ) Notice: Subject to any disclaimer, the term of this patent is extended or adjusted under 35 U.S.C. 154(b) by 0 days.

(21) Appl. No.: 16/443,028

(22) Filed: Jun. 17, 2019

(65) Prior Publication Data

US 2019/0383417 A1 Dec. 19, 2019

Related U.S. Application Data

(60) Provisional application No. 62/748,633, filed on Oct. 22, 2018, provisional application No. 62/686,213, filed on Jun. 18, 2018.

(51) Int. Cl.
*F15B 15/18* (2006.01)

(52) U.S. Cl.
CPC ..... *F15B 15/18* (2013.01)

(58) Field of Classification Search
CPC ..... F15B 15/18
See application file for complete search history.

(56) References Cited

U.S. PATENT DOCUMENTS

| | | | | |
|---|---|---|---|---|
| 2,591,410 A * | 4/1952 | Dayton | F15B 15/18 | 60/467 |
| 6,796,120 B2 * | 9/2004 | Franchet | F15B 7/006 | 60/413 |
| 9,631,455 B2 * | 4/2017 | Geiger | E21B 33/0355 | |
| 2010/0107864 A1 * | 5/2010 | Bushner | F15B 15/18 | 91/422 |

* cited by examiner

*Primary Examiner* — F Daniel Lopez
(74) *Attorney, Agent, or Firm* — Brown Rudnick LLP; Adam M. Schoen

(57) ABSTRACT

The invention generally relates a linear or roto-linear actuator comprising a combination of electrical and hydraulic actuator components for providing a combined electric and hydraulic-driving force.

23 Claims, 18 Drawing Sheets

LINEAR ACTUATOR

CROSS-REFERENCE TO RELATED APPLICATION(S)

This application claims priority to, and the benefit of, U.S. Provisional Application No. 62/686,213, filed on Jun. 18, 2018, and U.S. Provisional Application No. 62/748,633, filed Oct. 22, 2018, the contents of each of which are incorporated by reference herein in their entireties.

FIELD OF THE INVENTION

The invention generally relates to actuators, and, more particularly, to a linear or roto-linear actuator comprising a combination of electrical and hydraulic actuator components for providing a combined electric and hydraulic-driving force.

BACKGROUND

Linear actuators are widely used in many different industries. A linear actuator is commonly used to move an object along a straight line, either between two end points or to a defined position. The most widely used linear actuators are hydraulic cylinders and electric linear actuators.

A hydraulic actuator generally consists of cylinder or fluid motor that uses hydraulic power to facilitate mechanical operation. The mechanical motion gives an output in terms of linear, rotatory or oscillatory motion. Hydraulic actuators work by pumping a high pressure fluid into the fluid reservoirs located on either side of a piston in a hydraulic cylinder. While hydraulic actuators are known to be extremely powerful, capable of exerting a large force, and very reliable due to their small number of moving parts, hydraulic actuators have drawbacks. For example, hydraulic actuators require extensive plumbing and external pumps, resulting in complex systems, and further suffer from limited acceleration as a result of limited flow speed in hydraulic hoses or other fluid lines.

An electric actuator is generally powered by a motor that converts electrical energy into mechanical torque. For example, some electric linear actuators use rotatory motors to drive a nut and ball screw assembly. While electric actuators are able to function with only the application electricity, thereby making then very useful for small systems where the noise, expense, or energy requirements are critical, electric actuator systems tend to have complex gear trains and are subject to failure due to wear on the ball screw, nuts, and gears.

In recent years electro-hydraulic actuators have become popular. Such systems utilize a typical hydraulic cylinder and add a motor, hydraulic pump, accumulator, check valves, and the like, into a single package. While simpler to use than a conventional hydraulic system, these systems are still complex and expensive.

SUMMARY

The present invention is directed to a linear or roto-linear actuator comprising a combination of electrical and hydraulic actuator components for providing a combined electric and hydraulic-driving force, and the benefits of each. The actuator of the present invention combines the benefits of hydraulic cylinders and electric actuators without many of the drawbacks. In particular, the actuator of the present disclosure provides the power density and robustness of a hydraulic actuator without requiring the extensive plumbing and external pumps generally required in a hydraulic actuator system. Furthermore, the actuator of the present disclosure allows for a small size, quiet operation, and electric-only requirement of an electric actuator without requiring the complex gear trains and potential failure associated with typical components (ball screw, nuts, and gears) of an electric actuator.

In particular, the actuator of the present invention comprises a stator and a sealed cylinder member containing a hydraulic fluid within, wherein the stator and cylinder member are coaxially aligned with one another. In some embodiments, the stator surrounds the exterior of the sealed cylinder. In other embodiments, the stator is positioned within the sealed cylinder. The cylinder may be made of a non-ferrous material like titanium, aluminum, or carbon fiber to reduce interference with the movement or operation of any internal components within, specifically interference with the magnetic fields generated by the stator, which can lead to eddy currents (resulting in power loss) and potentially voltage differentials that can lead to sparking. The hydraulic fluid could be any incompressible fluid, likely oil or water-based hydraulic fluid, or potentially a compressible fluid like air. The cylinder member generally includes a rotor positioned within and containing permanent magnets, wherein the rotor is configured to rotate about a longitudinal axis. The rotor has a length that is less than an overall length of the cylinder, such that fluid reservoirs or chambers are formed on either end of the rotor at ends of the cylinder. The actuator further includes endcaps for enclosing each end of the cylinder, wherein o-rings or lip seals may be used to seal the cylinder and endcaps, thereby ensuring hydraulic fluid does not escape.

The actuator of the present invention further comprises a pump configured for high pressure and low flow. In one embodiment, the rotor comprises a gear pump. In particular, the rotor comprises an internal gear configured to drive a matching gear of the pump, which, in turn, results in hydraulic fluid being pumped from one reservoir or chamber to the other, thereby converting rotation of the rotor into linear displacement. The pump may include, but is not limited to a spur gear pump, a piston pump, a rotary vane pump, or any similar fixed or variable displacement pump configuration that may be configured for use in high pressure hydraulic systems. The actuator further comprises one or more piston shafts having one end coupled to the pump and an opposing end extending through an end of the cylinder through a seal. In one embodiment, at least two shafts are included, wherein such shafts may be placed off-center relative to a longitudinal axis about which the rotor rotates, so as to constrain the pump from rotating, while allowing the pump to slide within the cylinder. In other embodiments, the one or more piston shafts may be centered (i.e., coaxial with the rotor), but may include non-circular profiles or cross-sections so as to constrain the pump from rotating. Upon rotation of the rotor in a first direction, the meshing of pump gears in a first direction occurs, which results in hydraulic fluid being pumped from one reservoir or chamber to the other, thereby converting rotation of the rotor into linear displacement of the fluid, in turn causing linear displacement of the shaft in a first direction. Similarly, reversing the rotation of rotor in an opposite direction results in the meshing of gears in an opposite direction within the pump, which results in hydraulic fluid pumping to the other reservoir or chamber, thereby causing linear displacement of the shaft in a second, opposite direction. Accordingly, by providing a pump configured to rotate in opposite directions, the shaft is configured to apply force axially in both a push and pull directions. The cylinder may include an integrated expansion reservoir so that effects like thermal expansion and the pumping operation of the rotor do not cause pressures that exceed the maximum rated pressure of the cylinder. The cylinder may further includes overpressure valves that open at a set pressure to safely relieve pressure by dumping fluid into the low pressure side of the cylinder.

The pump may be substantially symmetric to allow substantially equal performance in either rotation direction (i.e., pushing or pulling directions). The one or more piston shafts can be supported by a variety of types of bearing, including, but not limited to, OILITE (sintered bronze) bearings or ball bearings. The rotor is configured to slide within the cylinder on a seal like an o-ring, dividing the cylinder into two separate fluid reservoirs. The output piston shafts are generally supported by a bearing and a seal to contain the hydraulic fluid. The pump will be integrated into the body of the rotor, generally at a smaller radius than the permanent magnets.

The rotor may be configured to rotate by way of a sensorless brushless DC (BLDC) motor via BLDC drive electronics or similar electronics. In some embodiments, the actuator may further include a shaft position sensor configured to sense a linear position of the shaft of the piston and provide a signal to the BLDC drive electronics to allow for closed shaft loop position control via user input or computer-controlled input.

BRIEF DESCRIPTION OF THE DRAWINGS

Features and advantages of the claimed subject matter will be apparent from the following detailed description of embodiments consistent therewith, which description should be considered with reference to the accompanying drawings.

Figure 1:
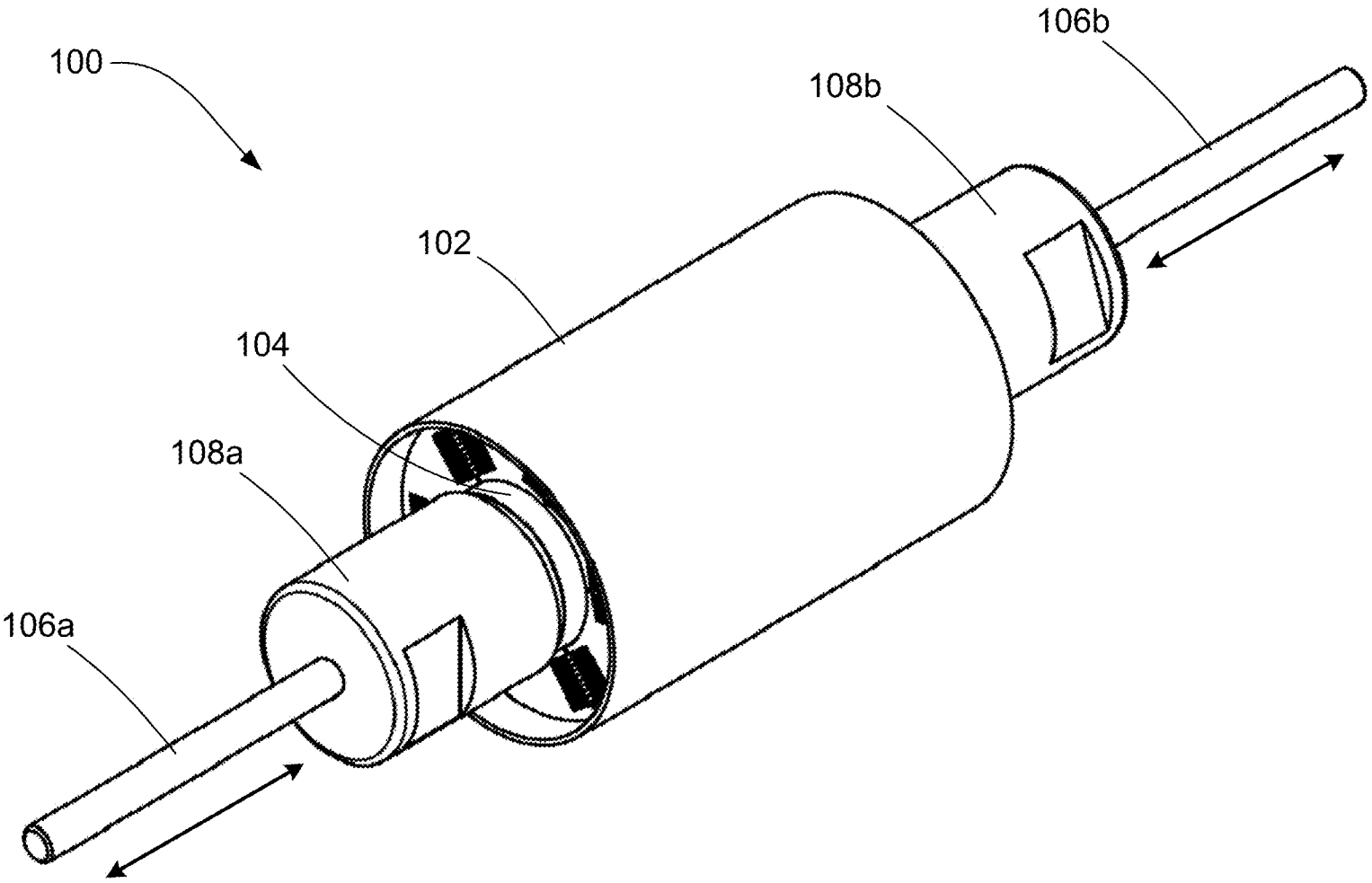
FIG. 1 is a perspective view of one embodiment of a linear actuator consistent with the present disclosure.

Features and advantages of the claimed subject matter will be apparent from the following detailed description of embodiments consistent therewith, which description should be considered with reference to the accompanying drawings.

DETAILED DESCRIPTION

The invention generally relates to actuators, and, more particularly, to a linear or roto-linear actuator comprising a combination of electrical and hydraulic actuator components for providing a combined electric and hydraulic-driving force. More specifically, the linear actuator of the present disclosure combines the best features of hydraulic cylinders, including power density and robustness, with the best features of electric actuators, including more compact size, quiet operation, and requirement of only electricity as a source of power.

In particular, the actuator of the present invention comprises a stator, similar to the stator in a brushless DC motor (BLDC), and a sealed cylinder member containing a hydraulic fluid within, wherein the stator and cylinder member are coaxially aligned with one another. In some embodiments, the stator surrounds the exterior of the sealed cylinder. In other embodiments, the stator is positioned within the sealed cylinder. The cylinder member generally includes a rotor positioned within and containing permanent magnets, wherein the rotor is configured to rotate about a longitudinal axis, induced by currents in the stator windings exerting a force on the magnets in the rotor. The rotor has a length that is less than an overall length of the cylinder, such that fluid reservoirs or chambers are formed on either end of the rotor at ends of the cylinder. The actuator further includes endcaps for enclosing each end of the cylinder, wherein o-rings or lip seals may be used to seal the cylinder and endcaps, thereby ensuring hydraulic fluid does not escape.

The actuator further comprises one or more piston shafts. The shafts may be rigidly affixed to the rotor, creating a rotary and linear actuator, or coupled only for linear force, for example through thrust bearings, allowing for linear motion without shaft rotation.

In some embodiments, the actuator further comprises an impeller or turbine member configured for high pressure and low flow, such that, upon rotation of the rotor, the turbine is configured to correspondingly rotate, thereby resulting in displacement of the hydraulic fluid. For example, upon rotation of the turbine in a first direction, hydraulic fluid is pumped from one reservoir or chamber to the other, thereby converting rotation of the rotor into linear displacement of the fluid, in turn causing linear displacement of the shaft in a first direction. Similarly, reversing the rotation of the turbine in an opposite direction results in hydraulic fluid pumping to the other reservoir or chamber, thereby causing linear displacement of the shaft in a second, opposite direction.

In other embodiments, the actuator comprises a pump configured for high pressure and low flow, such that, upon rotation of the rotor, internal gears on the pump operate and displace the hydraulic fluid. For example, in one embodiment, the actuator comprises a gear pump. In particular, the rotor comprises an internal gear configured to drive a matching gear of the pump, which, in turn, results in hydraulic fluid being pumped from one reservoir or chamber to the other (by way of the meshing of gears of the pump), thereby converting rotation of the rotor into linear displacement. The pump may include, but is not limited to a spur gear pump, a piston pump, a rotary vane pump, or any similar fixed or variable displacement pump configuration that may be configured for use in high pressure hydraulic systems. For example, as the pump gears rotate, they separate on the intake side of the pump, creating a void and suction which is filled by hydraulic fluid, which is then carried by the gears to the discharge side of the pump, where the meshing of the gears displaces the hydraulic fluid.

The actuator of the present invention combines the benefits of hydraulic cylinders and electric actuators without many of the drawbacks. In particular, the actuator of the present disclosure provides the power density and robustness of a hydraulic actuator without requiring the extensive plumbing and external pumps generally required in a hydraulic actuator system. Furthermore, the actuator of the present disclosure allows for a small size, quiet operation, and electric-only requirement of an electric actuator without requiring the complex gear trains and potential failure associated with typical components (ball screw, nuts, gears, speed reduction gear set) of an electric actuator.

Figure 2:
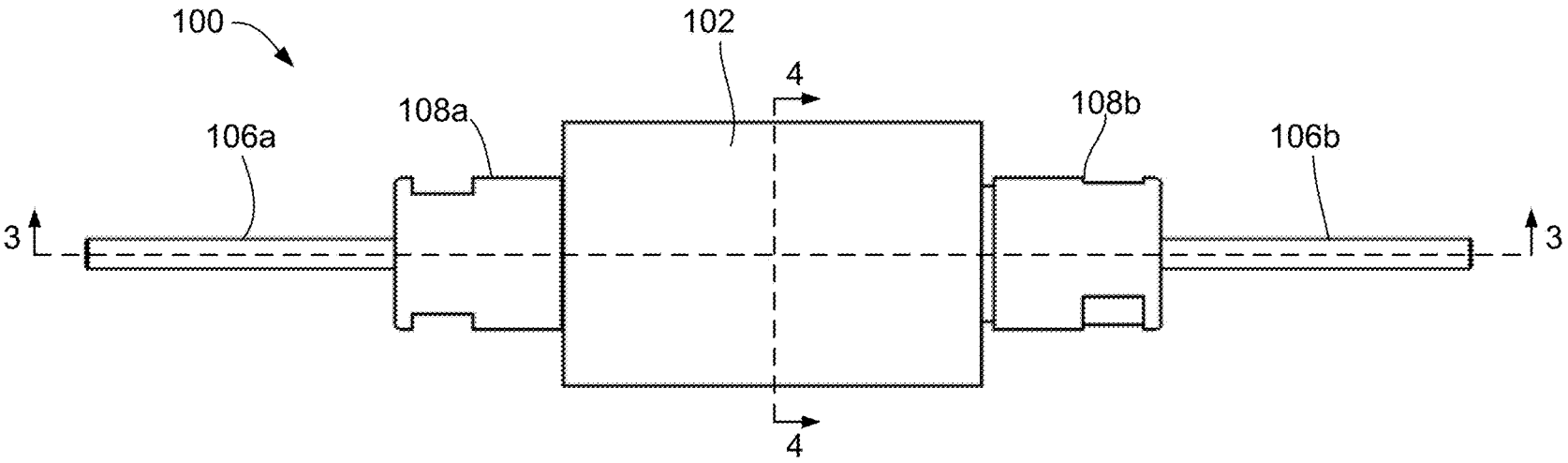
FIG. 2 is a side view of the linear actuator of FIG. 1.
Figure 3:
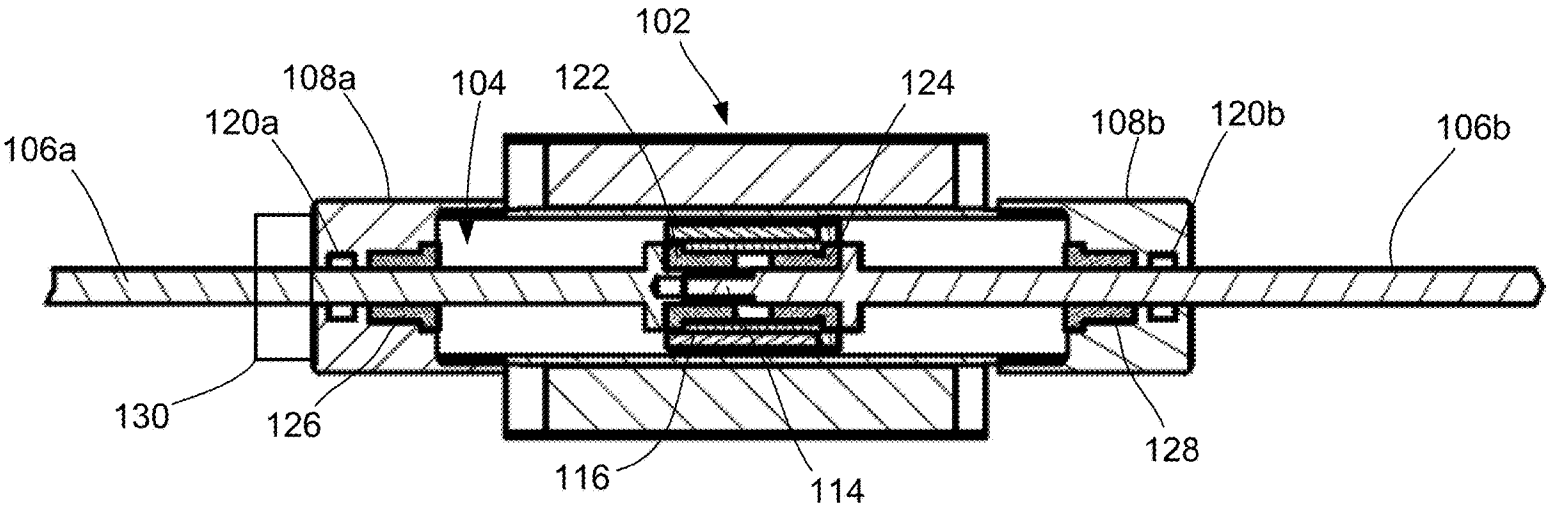
FIG. 3 is a side sectional view of the linear actuator taken along lines 3-3 of FIG. 2.
Figure 4:
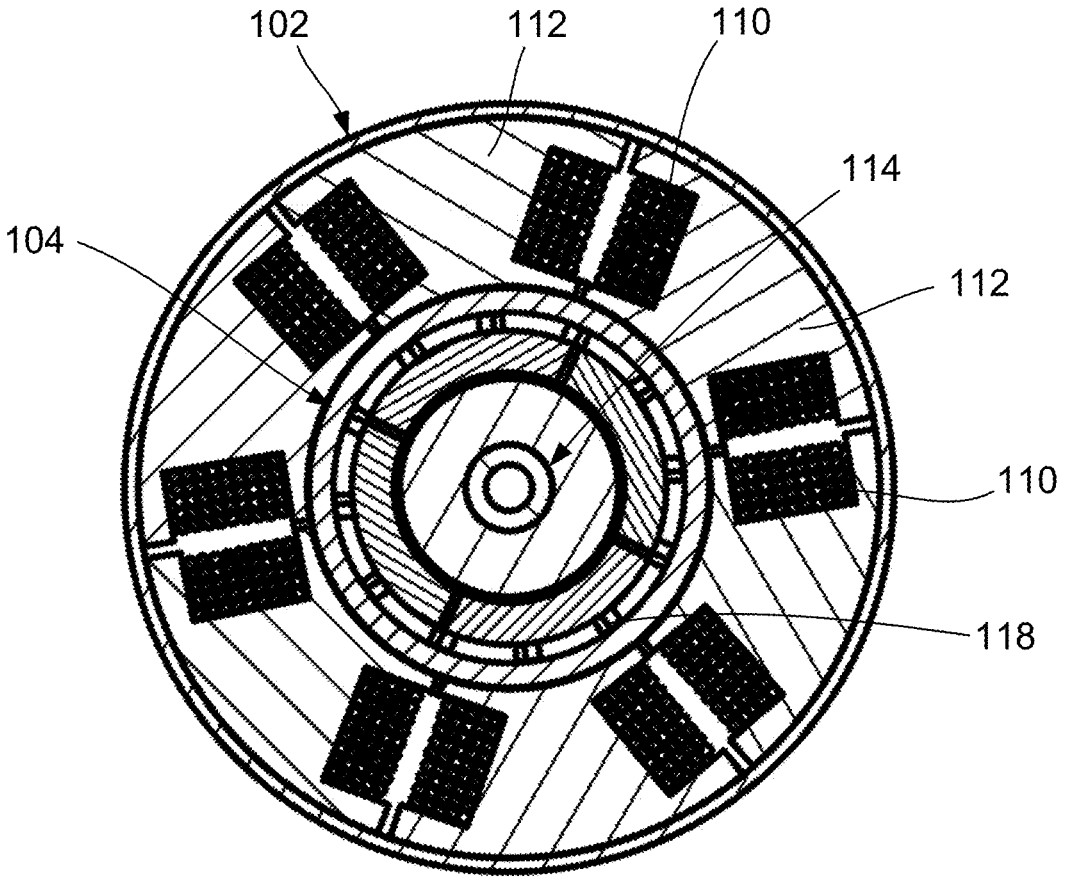
FIG. 4 is a front view, partly in section, of the linear actuator taken along lines 4-4 of FIG. 2.

FIG. 1 is a perspective view of a linear actuator 100 consistent with the present disclosure. FIG. 2 is a side view of a linear actuator 100. FIGS. 3 and 4 are side and front sectional views of the linear actuator 100 taken along lines 3-3 and 4-4 of FIG. 2, respectively.

As shown, the actuator 100 comprises a stator 102 surrounding a sealed cylinder member 104 containing a hydraulic fluid within, wherein the stator 102 and cylinder member 104 are coaxially aligned with one another. The cylinder 104 may be made of a non-ferrous material like titanium, aluminum, or carbon fiber to reduce interference with the movement or operation of any internal components within. The hydraulic fluid could be any incompressible fluid, likely oil or water-based hydraulic fluid. As will be described in greater detail herein, the actuator comprises one or more piston shafts 106 configured to move (i.e., linear displacement along longitudinal axis of the cylinder) upon operation of a drive mechanism of the actuator, which includes a rotor. In the illustrated embodiment, the actuator comprises a pair of piston shafts 106*a*, 106*b* positioned on corresponding opposing ends of the cylinder 104. The ends of the cylinder 104 are further enclosed with end caps 108*a*, 108*b*.

The stator 102 is similar to stators used in brushless DC motors (BLDC) and includes copper windings 110 and laminated ferromagnetic cores 112. The cylinder 104 generally includes a rotor 114 positioned within and further includes permanent magnets 116, with two or more N-S pairs of radially magnetized magnets. The rotor 114 has a length that is less than an overall length of the cylinder 104, such that fluid reservoirs or chambers are formed on either end of the rotor 114 at ends of the cylinder 104. The actuator 100 further includes o-rings or lip seals 120*a*, 120*b* may be used to seal the cylinder 104 and corresponding endcaps 108*a*, 108*b*, thereby ensuring hydraulic fluid does not escape. In some embodiments, a metal sealing surface exists between the cylinder 104 and each of the end caps 108*a*, 108*b*. The metal sealing surface is precisely machined to make a metal to metal static seal to keep the hydraulic fluid within the cylinder.

The rotor 114 further comprises an impeller or turbine member 118 configured for high pressure and low flow, such that, upon rotation of the rotor 114, hydraulic fluid is pumped from one reservoir or chamber to the other, thereby converting rotation of the rotor 114 into linear displacement of the rotor. The actuator 100 further comprises one or more piston shafts 106*a*, 106*b* having one end coupled to the rotor 114 and an opposing end extending through an end of the cylinder 104 through a seal 120*a*, 120*b*. For example, as shown in the figures, the piston shafts 106 extend from both ends of the rotor 114, exiting the cylinder 104 through the seals 120*a*, 120*b*. The shafts 106 may be rigidly affixed to the rotor 114 creating a roto-linear actuator, or coupled only for linear force, for example through thrust bearings 122, 124, allowing for just linear motion without shaft rotation.

Upon rotation of the turbine 118 in a first direction, hydraulic fluid is pumped from one reservoir or chamber to the other, thereby converting rotation of the rotor 114 into linear displacement of the shaft 106 in a first direction. Similarly, reversing the rotation of the turbine 118 in an opposite direction results in hydraulic fluid pumping to the other reservoir or chamber, thereby causing linear displacement of the shaft 106 in a second, opposite direction.

Accordingly, by providing a turbine 118 configured to rotate in opposite directions, the shaft 106 is configured to apply force axially in both a push and pull directions. The cylinder 104 may include an integrated expansion reservoir so that effects like thermal expansion and the pumping operation of the rotor do not cause pressures that exceed the maximum rated pressure of the cylinder 104.

The impeller or turbine 118 may be substantially symmetric to allow substantially equal performance in either rotation direction (i.e., pushing or pulling directions). The shafts 106 can be supported by a variety of types of bearing, such as OILITE (sintered bronze) bearings or ball bearings 126, 128. In an actuator comprising two output shafts 106*a*, 106*b* (a pair of shafts positioned on opposing ends of the cylinder), the impeller or turbine 118 may be positioned on an outside diameter of the rotor 114 and the rotor 114 may be constrained to be coaxial with the cylinder 104 by bearings integrated into the endcaps 108*a*, 108*b* of the cylinder 104. The specific design of the impeller 118, including dimensions and geometry, will allow the designer to optimize the maximum shaft speed and maximum force for a specific application.

In an actuator comprising a single output shaft, the rotor may slide inside the cylinder, acting as a bushing sliding on the interior of the cylinder. In another embodiment, the rotor surface be a decoupled from the remainder of rotor to reduce rotational friction between the rotor and shaft wall. The output piston shaft is generally supported by a bearing and a seal to contain the hydraulic fluid. Accordingly, the impellor or turbine may be integrated into the body of the rotor, either at a larger or smaller radius than the permanent magnets.

Figure 5:
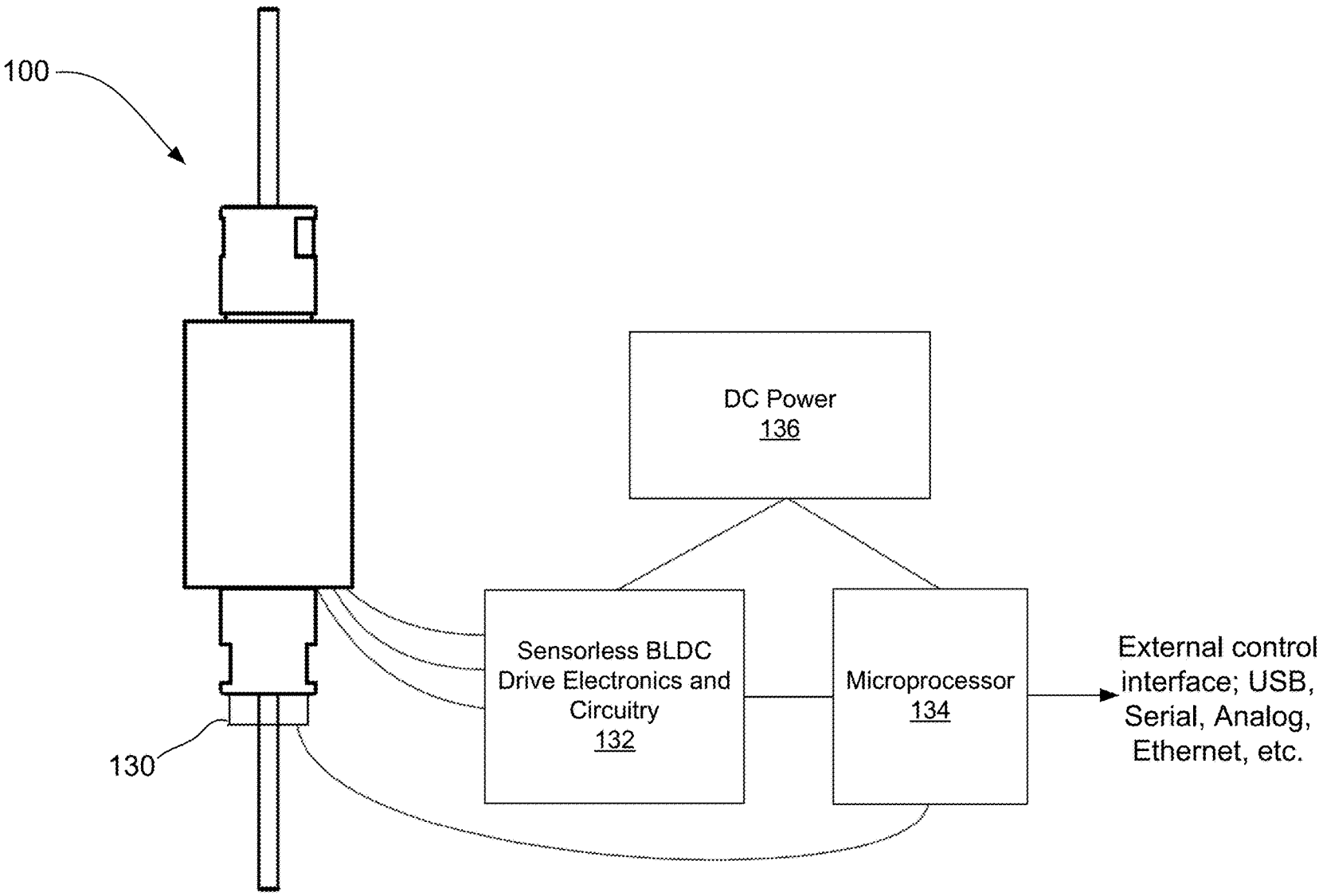
FIG. 5 is a schematic illustrating the linear actuator and brushless DC motor (BLDC) drive electronics or similar electronics for operating a linear actuator consistent with the present disclosure and transmitting signals therewith.

FIG. 5 is a schematic illustrating the linear actuator 100 and brushless DC (BLDC) drive electronics or similar electronics for operating the linear actuator 100 and transmitting signals therewith. The rotor 114 may be configured to rotate by way of a sensorless BLDC motor via BLDC drive electronics 132 or similar electronics. In some embodiments, the actuator 100 may further include a shaft position sensor 130 configured to sense a linear position of the shaft 106 of the piston and provide a signal to the BLDC drive electronics 132 and a microprocessor 134 to allow for closed shaft loop position control via user input or computer-controlled input. In some embodiments, if a shaft 106 is rigidly affixed to the rotor, a hall sensor or similar rotation sensor may be used to commutate the rotor as in a conventional BLDC drive system. The BLDC drive electronics may further include a power source, such as DC power 136, to power the components of the actuator 100 and/or the BLDC drive electronics 132 and microprocessor 134.

Figure 6A:
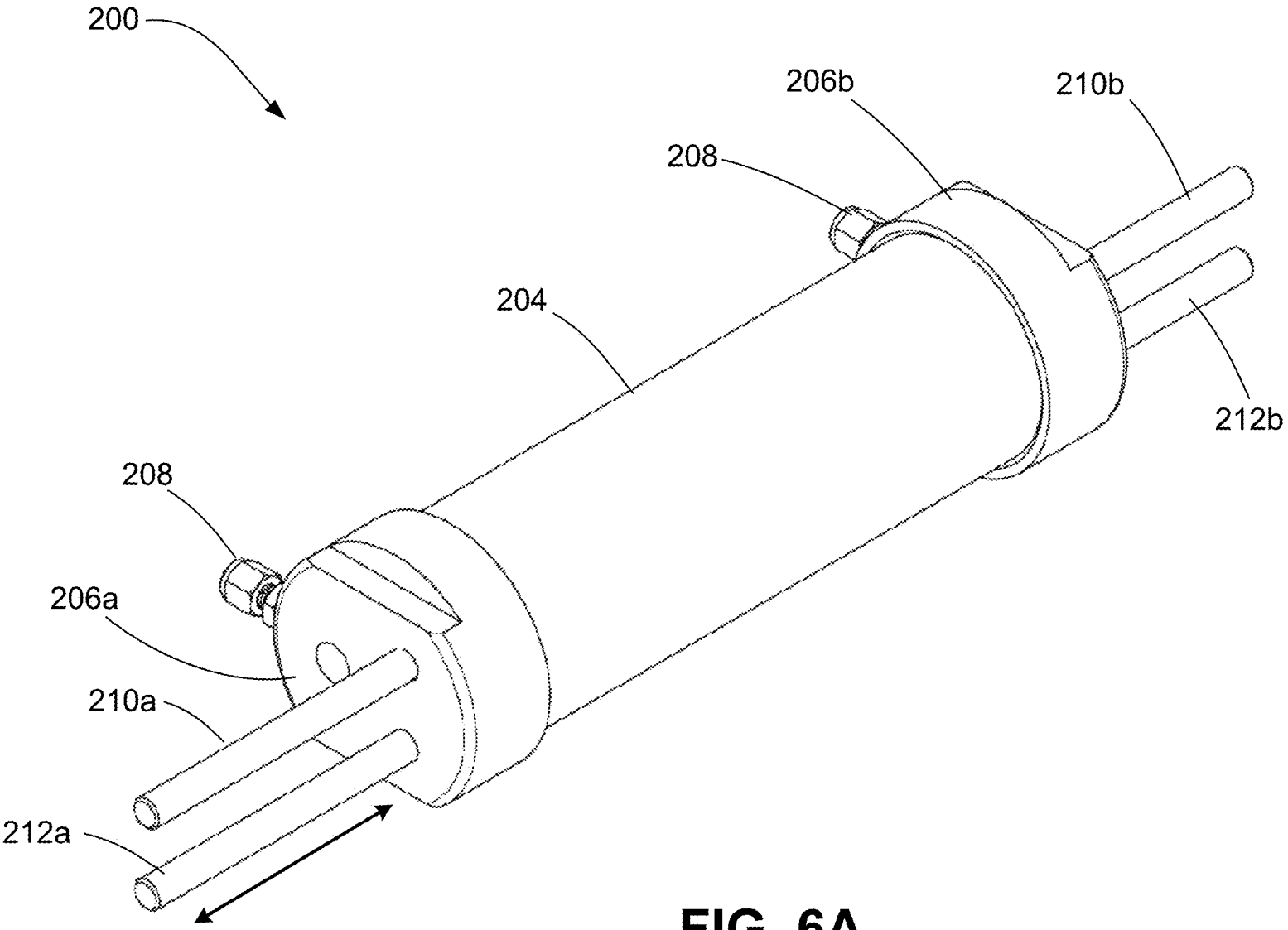
FIG. 6A is a perspective view of another embodiment of a linear actuator consistent with the present disclosure and FIG. 6B is a perspective view of the linear actuator of FIG. 6 illustrating internal components.
Figure 6B:
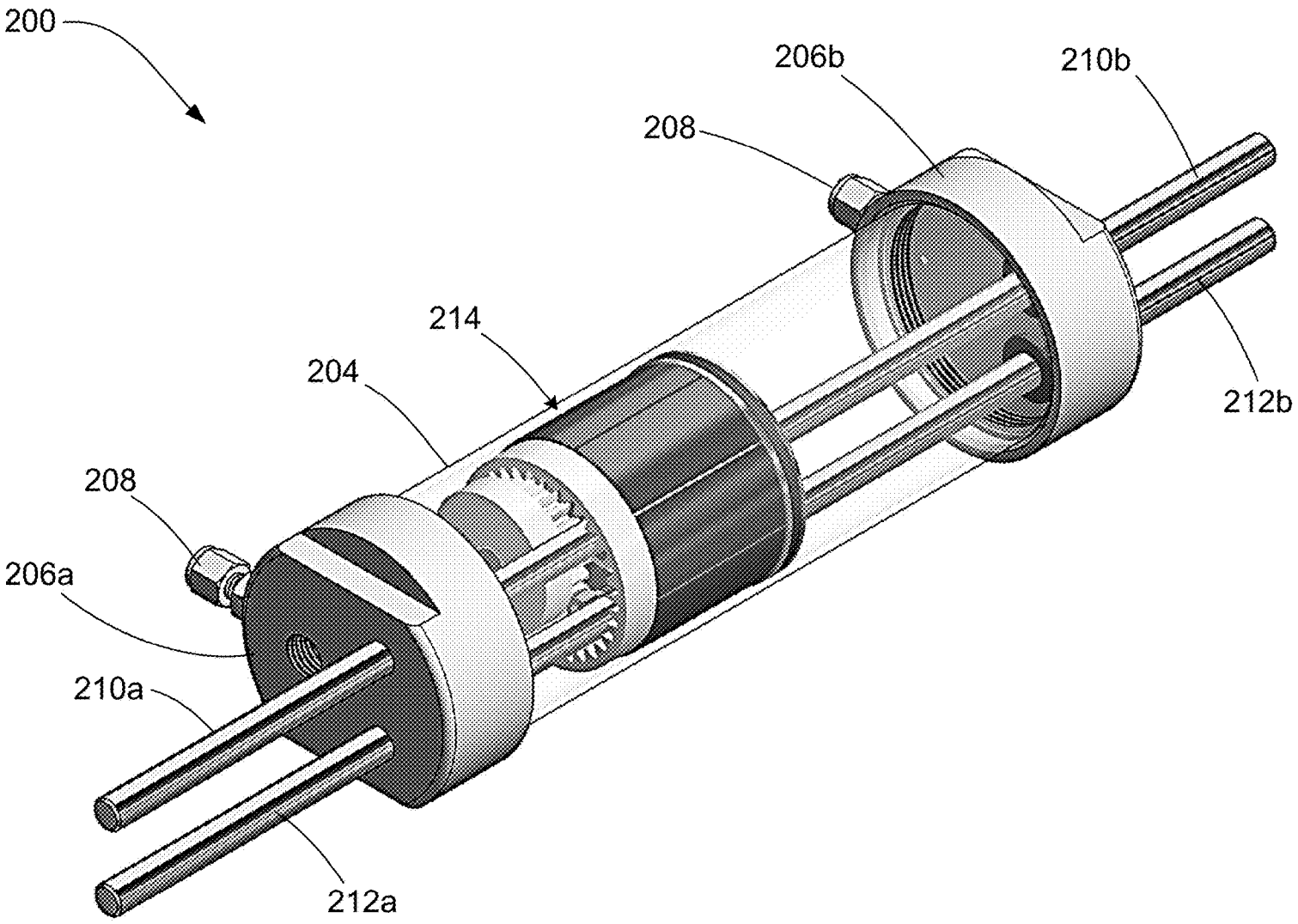
Figure 7:
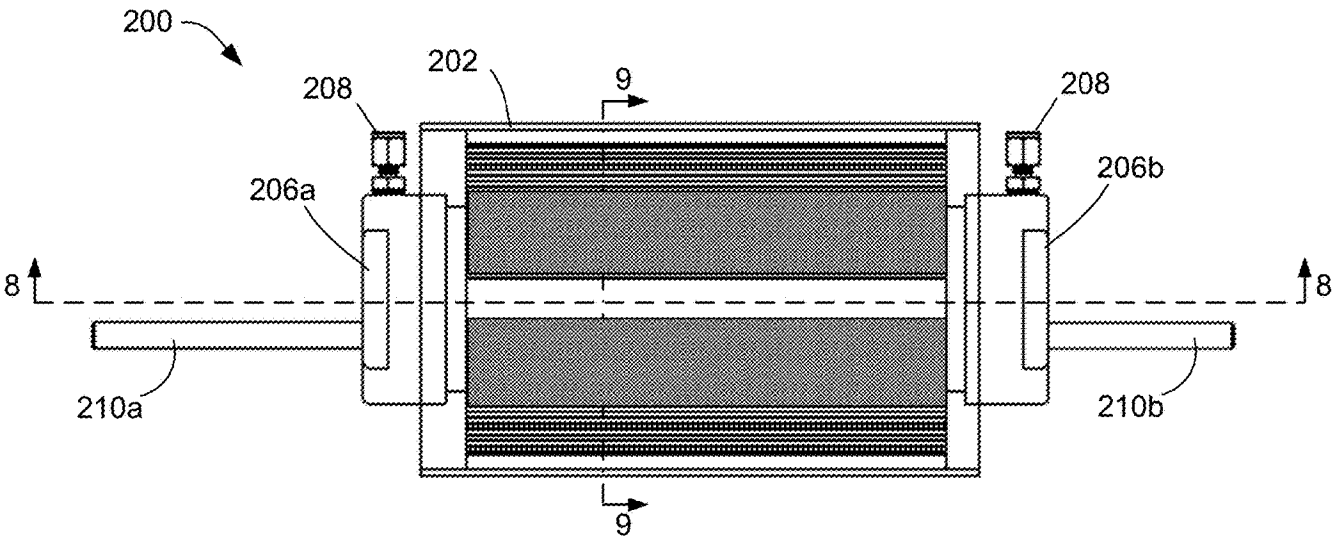
FIG. 7 is a side view of the linear actuator of FIG. 6.
Figure 8:
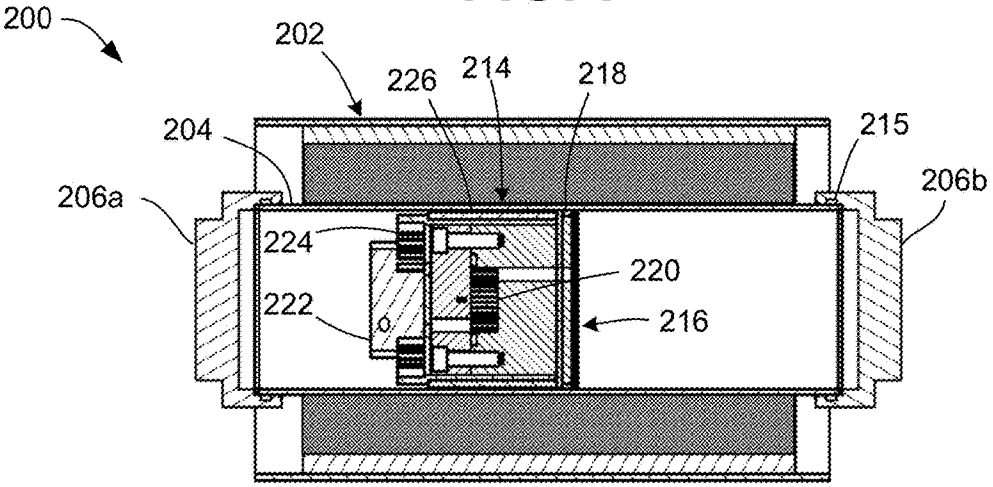
FIG. 8 is a side sectional view of the linear actuator taken along lines 8-8 of FIG. 7.
Figure 9:
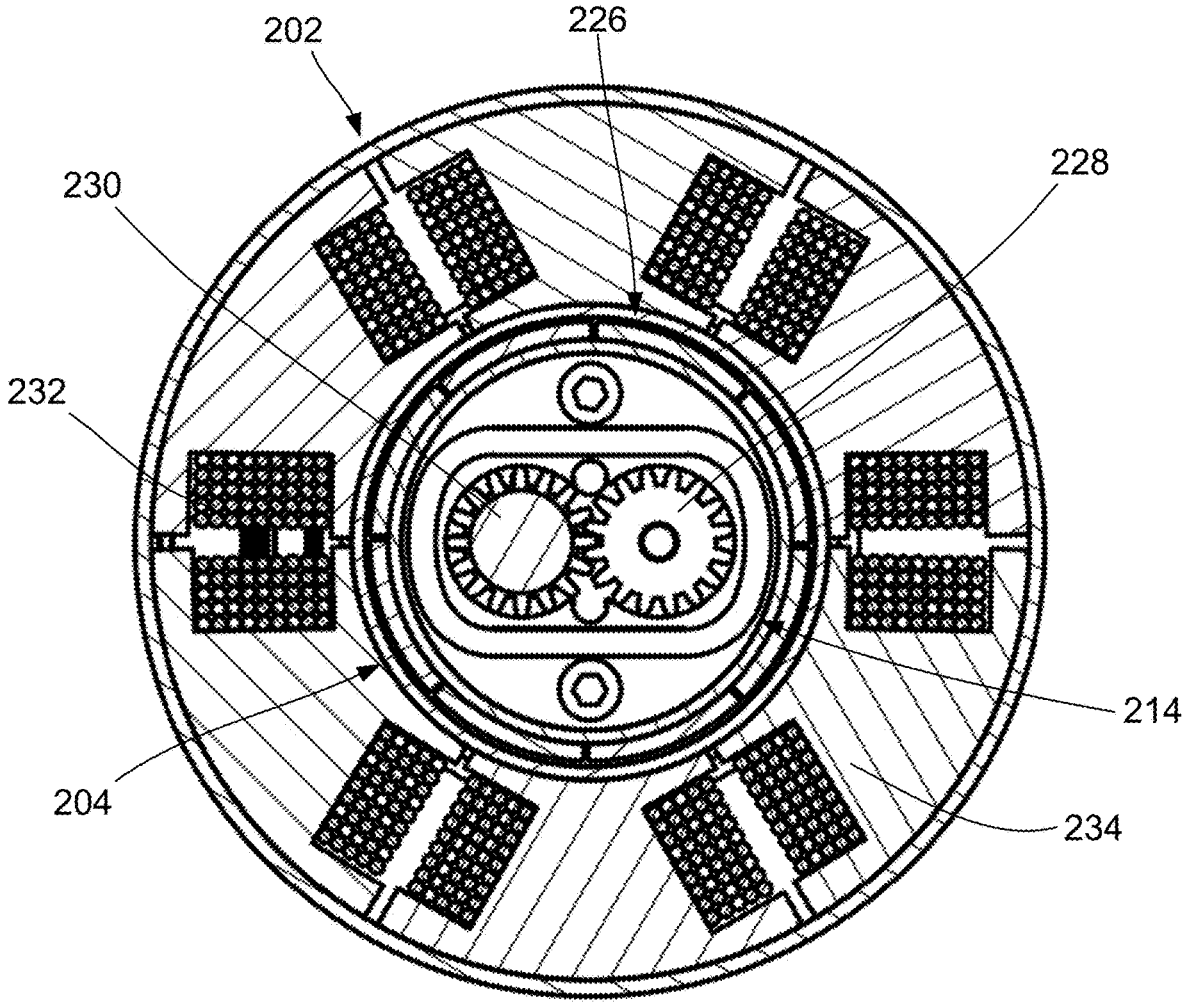
FIG. 9 is a front view, partly in section, of the linear actuator taken along lines 9-9 of FIG. 7.
Figure 10:
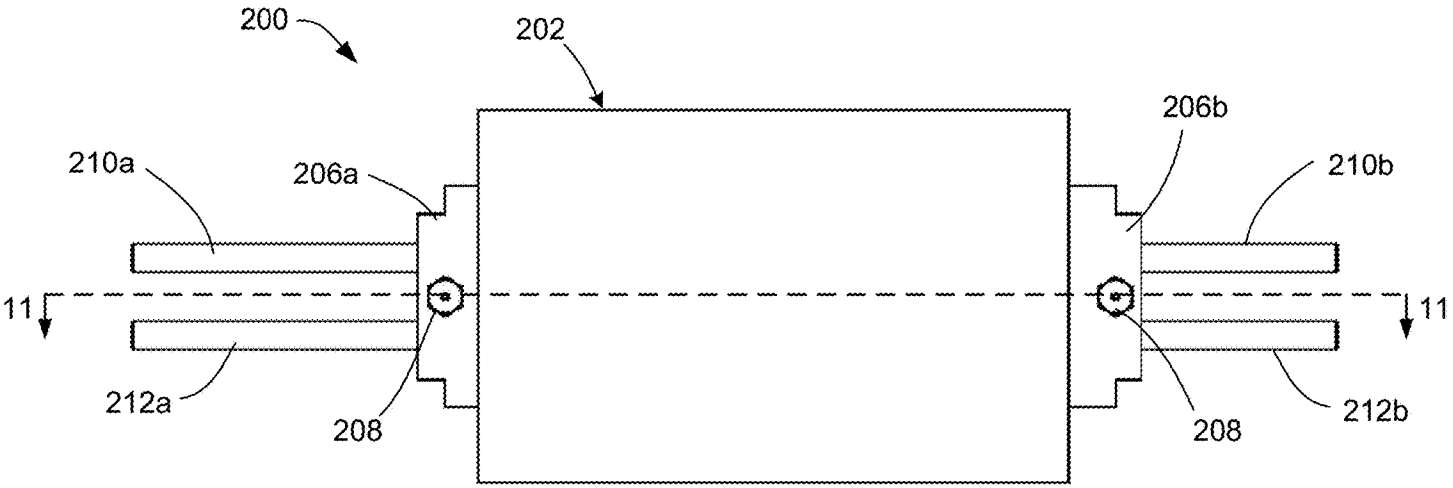
FIG. 10 is a top view of the linear actuator of FIG. 6.
Figure 11:
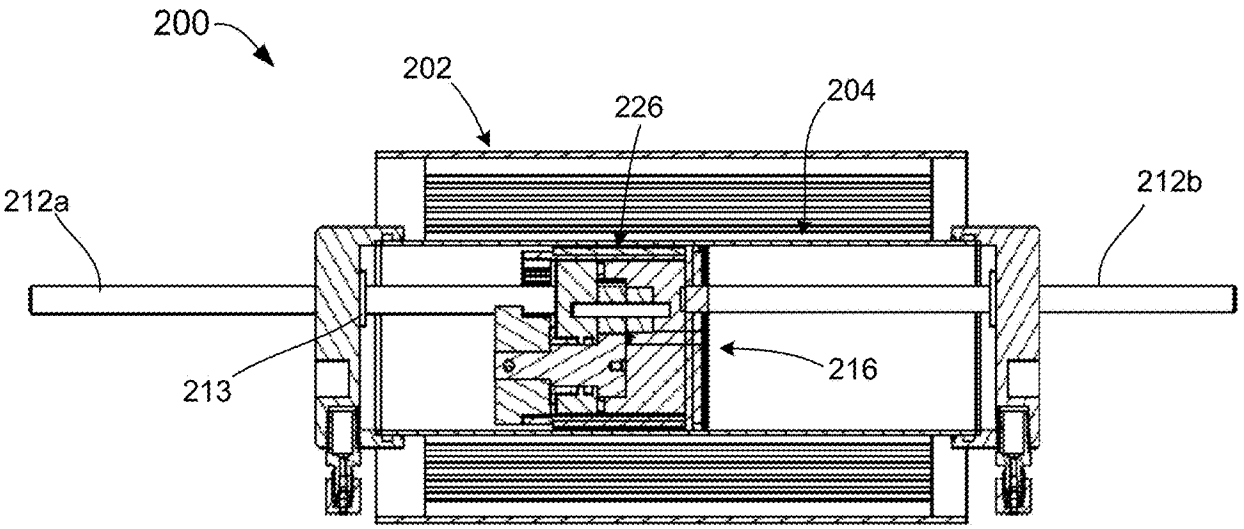
FIG. 11 is a side sectional view of the linear actuator taken along lines 11-11 of FIG. 10.

FIGS. 6A and 6B are perspective views of another embodiment of a linear actuator 200 consistent with the present disclosure (FIG. 6B illustrating the cylinder in phantom so as to provide a view of the internal components of the linear actuator 200). FIG. 7 is a side view of the linear actuator 200. FIGS. 8 and 9 are side and front sectional views of the linear actuator 200 taken along lines 8-8 and 9-9 of FIG. 7, respectively. FIG. 10 is a top view of the linear actuator 200 and FIG. 11 is a side sectional view of the linear actuator 200 taken along lines 11-11 of FIG. 10.

As shown, the actuator 200 comprises a stator 202 (shown in FIGS. 7-11) surrounding a sealed cylinder member 204 containing a hydraulic fluid within, wherein the stator 202 and cylinder member 204 are coaxially aligned with one another. The cylinder 204 may be made of a non-ferrous material like titanium, aluminum, or carbon fiber to reduce interference with the movement or operation of any internal components within. The hydraulic fluid could be any incompressible fluid, likely oil or water-based hydraulic fluid. As will be described in greater detail herein, the actuator comprises one or more piston shafts 210 and 212 configured to move (i.e., linear displacement along longitudinal axis of the cylinder) upon operation of a drive mechanism of the actuator, which includes a rotor. In the illustrated embodiment, the actuator 200 comprises two pairs of piston shafts (first pair of piston shafts 210*a*, 210*b* and second pair of piston shafts 212*a*, 212*b*) each comprising ends extending through respective ends of the cylinder 204. The ends of the cylinder 204 are further enclosed with end caps 206*a*, 206*b*. In order to keep the volume of hydraulic fluid required within the actuator 200 system fixed, shafts of the same diameter may be employed on both ends of the cylinder. Alternatively, an expansion tank can be used on each end to supply the required fluid. In order to keep the actuator 200 system from exceeding a safe operating pressure, hydraulic overpressure valves 208 (208*a*, 208*b*) can be employed to connect the two fluid reservoirs in both flow directions. The actuator 200 further includes o-rings or lip seals 213, 215 that may be used to seal the cylinder 204 and corresponding endcaps 206*a*, 206*b*, thereby ensuring hydraulic fluid does not escape through apertures through which the piston shafts 210*a*, 210*b*, 212*a*, and 212*b* extend. In some embodiments, a metal sealing surface exists between the cylinder 204 and each of the end caps 206*a*, 206*b*. The metal sealing surface is precisely machined to make a metal to metal static seal to keep the hydraulic fluid within the cylinder.

The cylinder 204 generally includes a rotor 214 positioned within which further includes permanent magnets 226 with two or more N-S pairs of radially magnetized magnets. The rotor 214 has a length that is less than an overall length of the cylinder 204, such that fluid reservoirs or chambers are formed on either end of the rotor 214 at ends of the cylinder 204.

The actuator 200 further includes a pump 216 configured for high pressure and low flow. In particular, the pump 216 is positioned coaxially within the rotor 214. The rotor 214 may include one or more internal gears 224 along an inner diameter thereof configured to mate with and drive a matching gear 222 of the pump 216, which, in turn, results in hydraulic fluid being pumped from one reservoir or chamber to the other (as a result of gears meshing within the pump), thereby converting rotation of the rotor into linear displacement. For example, the pump 216 may include, but is not limited to a spur gear pump, a piston pump, a rotary vane pump, or any similar fixed or variable displacement pump configuration that may be configured for use in high pressure hydraulic systems. The pump may be fixed or variable displacement. The pump 216 includes an o-ring 218 or similar seal that seals against the inner surface of the cylinder 204, allowing a pressure difference between the two fluid reservoirs or chambers.

In one embodiment, at least two shafts 210, 212 (consisting of a first pair of shafts 210*a*, 210*b* and a second pair of shafts 212*a*, 212*b*) are included, wherein such shafts may be placed off-center relative to a longitudinal axis about which the rotor 214 rotates, so as to constrain the pump 216 from rotating, while allowing the pump 216, and the rotor 214, to slide within the cylinder 204. It should be noted, however, that other methods of restraining rotation of the pump may be incorporated into the linear actuator 200 of the present disclosure. For example, a keyway may be cut into the cylinder and the pump may include a member extending into and engaging the keyway, to thereby prevent rotation of the pump. Yet still, in other embodiments, the one or more piston shafts may be centered (i.e., coaxial with the rotor), but may include non-circular profiles or cross-sections so as to constrain the pump from rotating.

The stator 202 is similar to stators used in brushless DC motors (BLDC) and includes copper windings 232 and laminated ferromagnetic cores 234. Upon rotation of the rotor 214, induced by currents in the stator windings 232 exerting a force on the magnets 226 in the rotor 214, hydraulic fluid is pumped from one reservoir or chamber to the other. This causes a pressure differential between the fluid reservoirs, causing a new force to be exerted on the rotor 214 and pump 216 assembly and causing it to slide towards the low pressure reservoir. This linear motion is the desired outcome of the system.

For example, upon rotation of the rotor 214 in a first direction, the meshing of pump gears in a first direction occurs (i.e., meshing between the fixed gear 228 and the driven gear 230 of the pump 216), which results in hydraulic fluid being pumped from one reservoir or chamber to the other, thereby converting rotation of the rotor 214 into linear displacement of the fluid, which subsequently causes linear displacement of at least one of the shafts 210*a*, 210*b*, 212*a*, 212*b* in a first direction. Similarly, reversing the rotation of rotor 214 in an opposite direction results in the meshing of pump gears in an opposite direction, which results in hydraulic fluid pumping to the other reservoir or chamber, thereby causing linear displacement of the shaft(s) in a second, opposite direction. Accordingly, by providing a pump configured to rotate in opposite directions, the shaft is configured to apply force axially in both a push and pull directions.

The pump 216 may be substantially symmetric to allow substantially equal performance in either rotation direction (i.e., pushing or pulling directions). The one or more piston shafts can be supported by a variety of types of bearing, including, but not limited to, OILITE (sintered bronze) bearings or ball bearings. The rotor 214 is configured to slide within the cylinder 204 on a seal like an o-ring, dividing the cylinder into two separate fluid reservoirs. The output piston shafts are generally supported by a bearing and a seal to contain the hydraulic fluid. The pump 216 will be integrated into the body of the rotor 214, generally at a smaller radius than the permanent magnets.

It should be noted that the rotor 214 of actuator 200 may be configured to rotate by way of a sensorless brushless DC (BLDC) motor via BLDC drive electronics or similar electronics, such as those illustrated in FIG. 5. In some embodiments, the actuator 200 may further include a shaft position sensor configured to sense a linear position of the shaft of the piston and provide a signal to the BLDC drive electronics to allow for closed shaft loop position control via user input or computer-controlled input in a similar manner as previously described herein with reference to FIG. 5.

Figure 12:
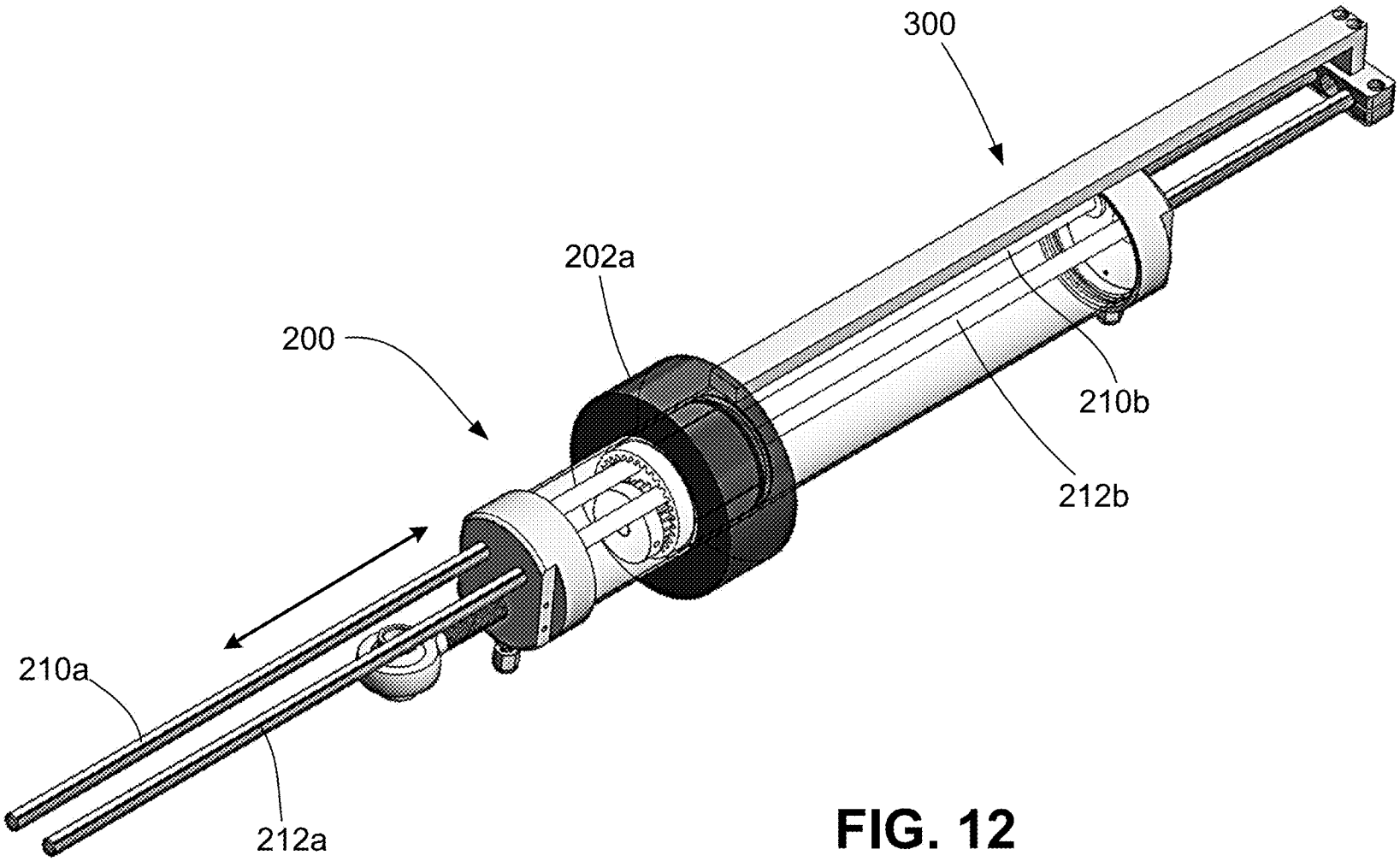
FIG. 12 is a perspective view of the linear actuator of FIG. 6 including a stator configured to move concurrently with the rotor, via a rigid guide member, to thereby accommodate longer displacement actuators.

FIG. 12 is a perspective view of the linear actuator 200 including a stator 202*a* configured to move concurrently with the rotor 214, via a rigid attachment member 300, to thereby accommodate longer displacement actuators. For example, a stator that is the length of the entire cylinder may prove to be expensive and lead to unnecessary power loss due to resistive losses in the stator windings. Accordingly, as shown, a stator 202*a* that is roughly the length of the permanent magnets in the rotor may be constructed and coupled to the shafts 210*a*, 210*b*, 212*a*, 212*b* on either end of the cylinder with a rigid attachment, which allows the stator to be the minimal size and to slide with the pump, keeping the stator and pump rotor aligned.

Figure 13:
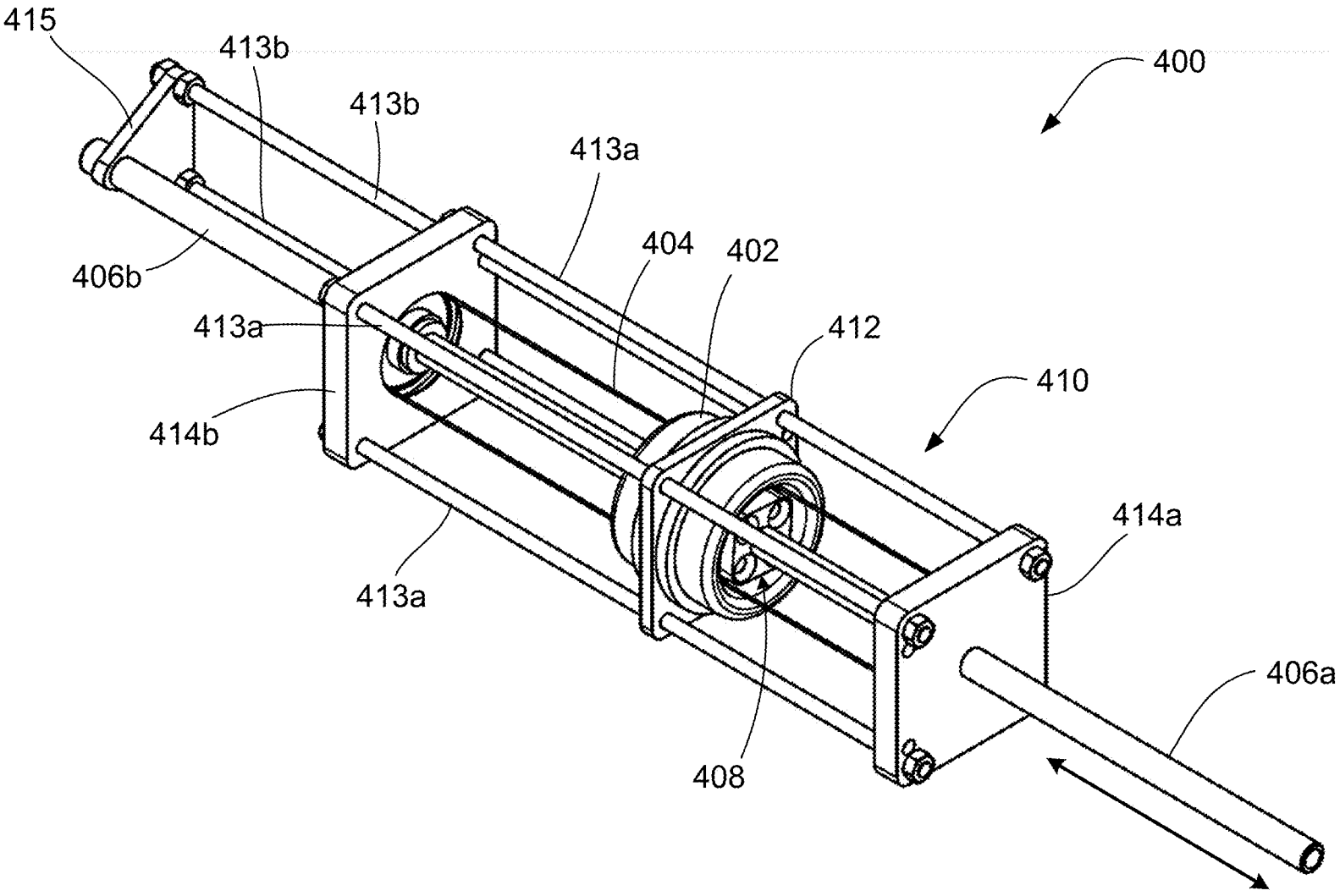
FIG. 13 is a perspective view of another embodiment of a linear actuator consistent with the present disclosure, illustrating a stator, a rotary vane pump, and a rotor configured to move concurrently with the one another along a longitudinal axis of the actuator via an external guide assembly, which further prevents the rotary vane pump and output shafts from rotating (spinning).
Figure 14:
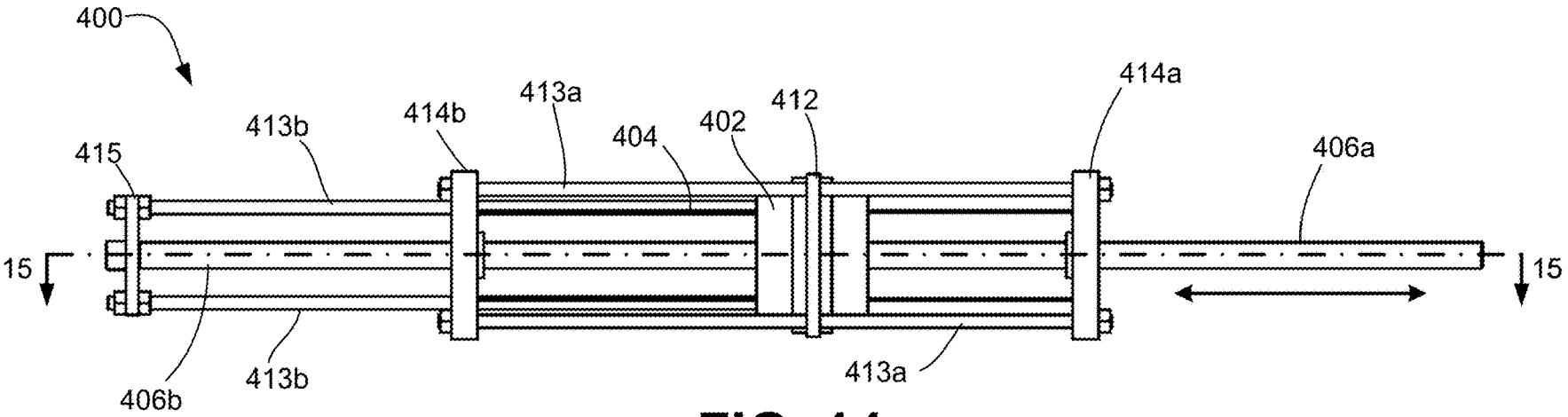
FIG. 14 is a side view of the linear actuator of FIG. 13.
Figure 15:
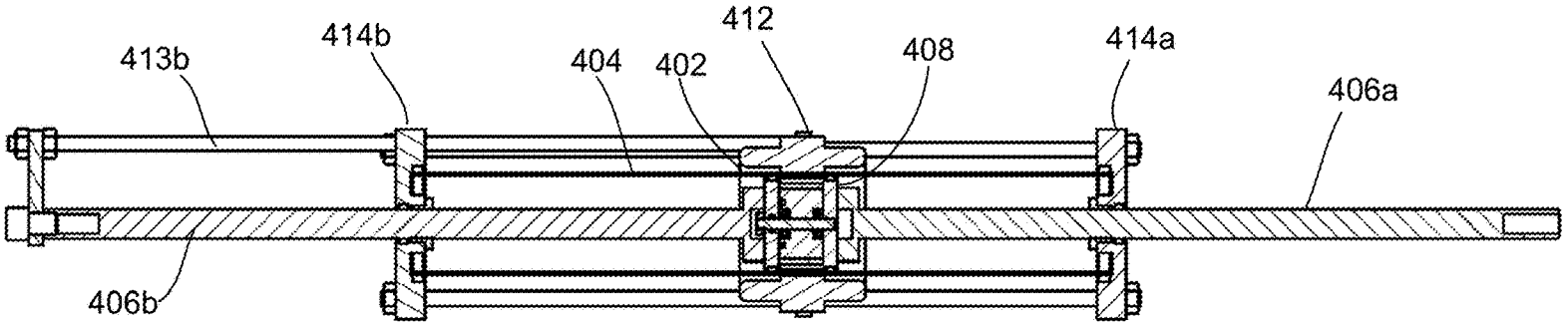
FIG. 15 is a side sectional view of the linear actuator taken along lines 15-15 of FIG. 14.
Figure 16:
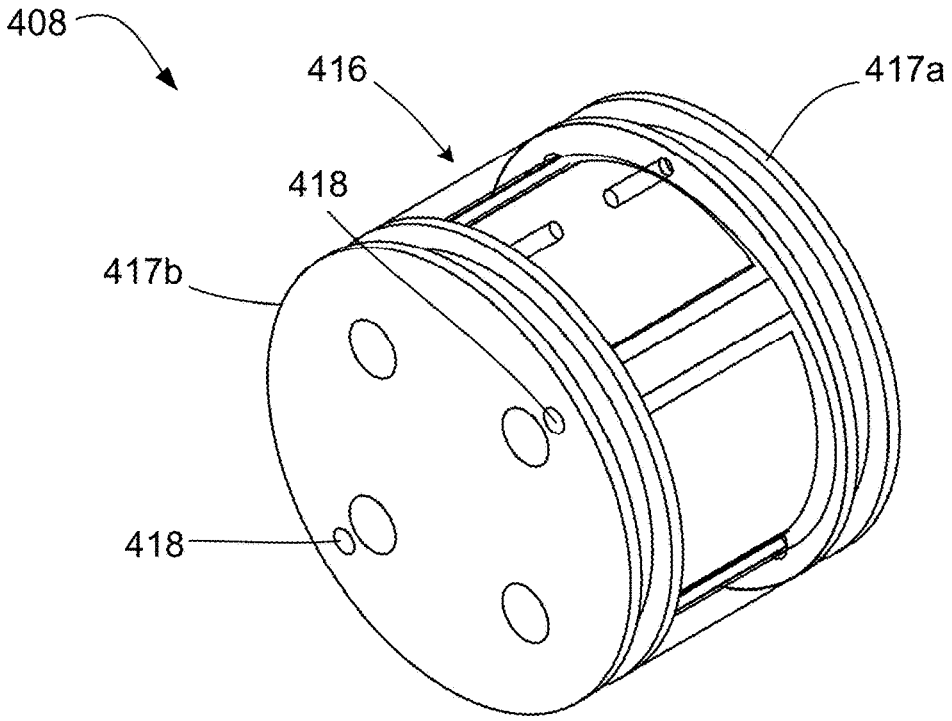
FIG. 16 is a perspective view of the rotary vane pump of the linear actuator of FIG. 13.
Figure 17:
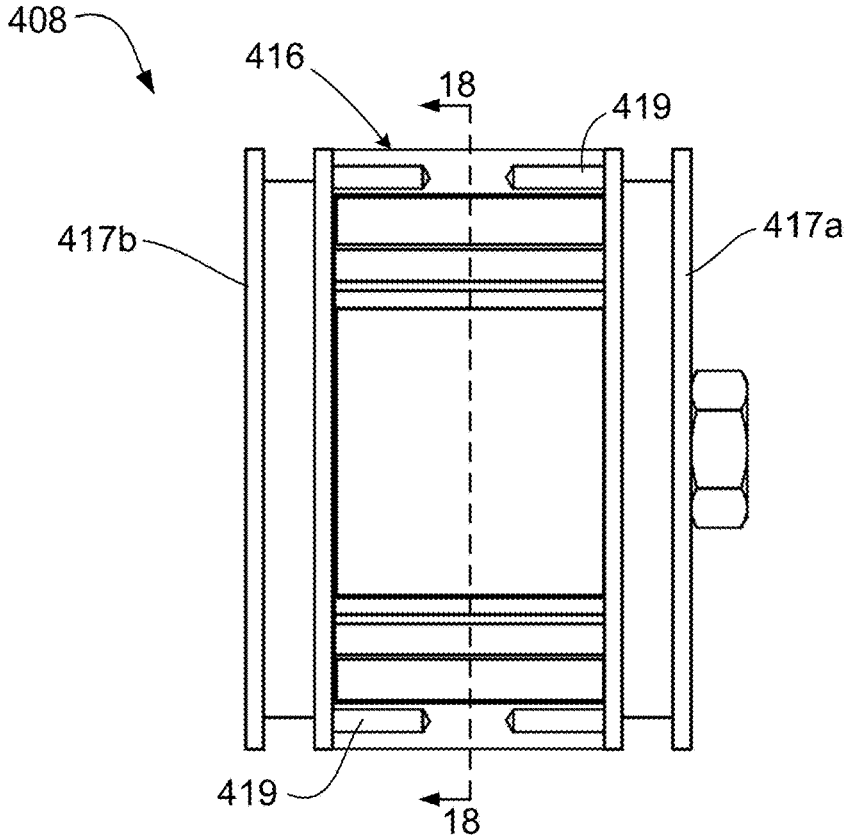
FIG. 17 is a side view of the rotary vane pump.
Figure 18:
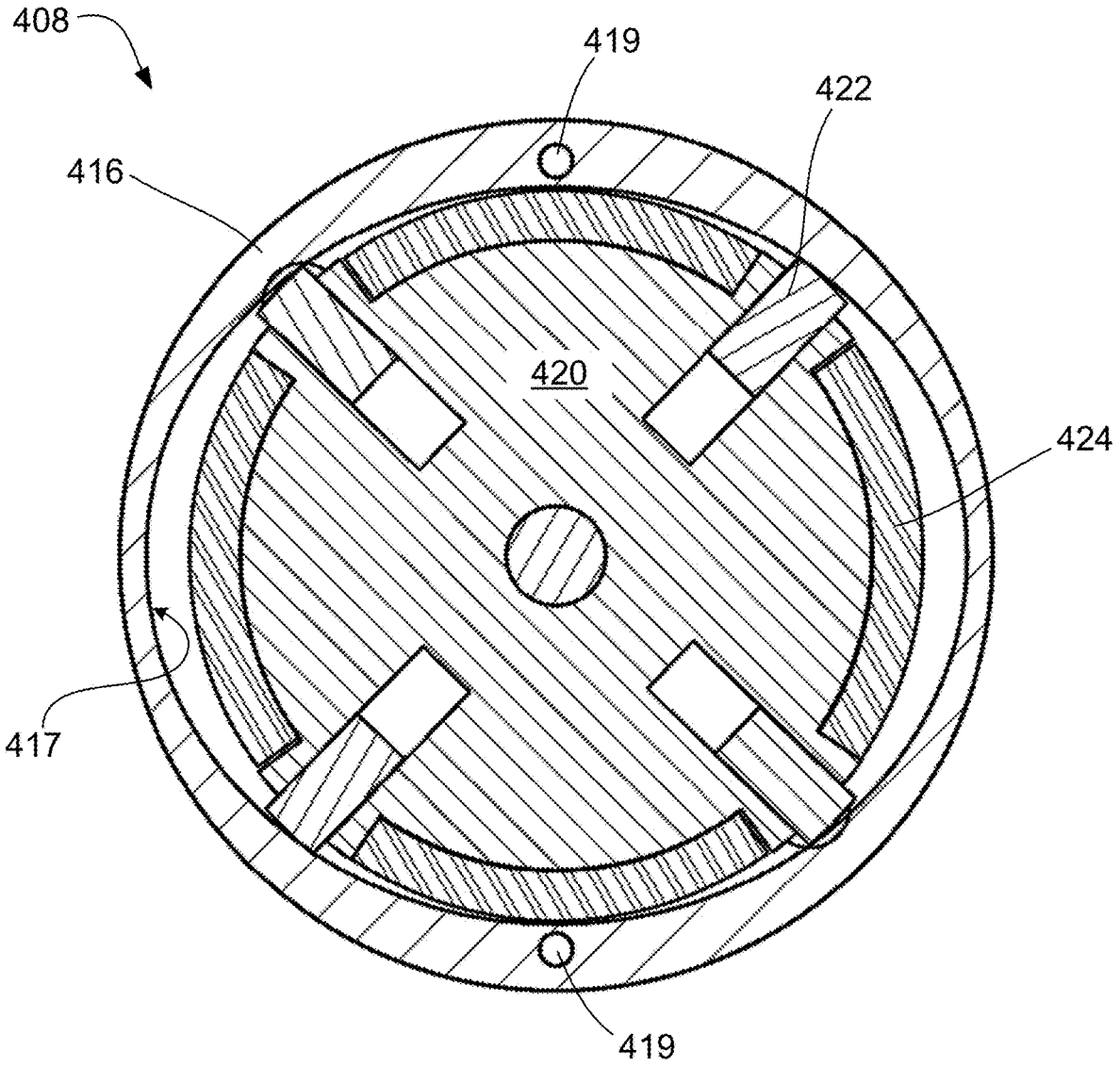
FIG. 18 is a cross-sectional view of the rotary vane pump taken along lines 18-18 of FIG. 17 illustrating the components of the rotary vane pump in greater detail.

FIG. 13 is a perspective view of another embodiment of a linear actuator 400 consistent with the present disclosure. Similar to the linear actuator 200 of FIG. 12, the linear actuator 400 includes an external guide assembly operably coupled to a stator and a rotor and configured to cause the stator and rotor to move concurrently with the one another along a longitudinal axis of the actuator 400, as will be described in greater detail herein. FIG. 14 is a side view of the linear actuator 400. FIG. 15 is a side sectional view of the linear actuator 400 taken along lines 15-15 of FIG. 14. FIGS. 16 and 17 are perspective and side views of the rotary vane pump 408. FIG. 18 is a cross-sectional view of the rotary vane pump 408 taken along lines 18-18 of FIG. 17.

As shown, the actuator 400 comprises a stator 402 surrounding a sealed cylinder member 404 containing a hydraulic fluid within, wherein the stator 402 and cylinder member 404 are coaxially aligned with one another. The cylinder 404 may be made of a non-ferrous material like titanium, aluminum, or carbon fiber to reduce interference with the movement or operation of any internal components within. The hydraulic fluid could be any incompressible fluid, likely oil or water-based hydraulic fluid. In the illustrated embodiment, the actuator comprises a single coaxial output shaft 406 configured to move (i.e., linear displacement along longitudinal axis of the cylinder 404) upon operation of a drive mechanism of the actuator 400, which includes a rotor 420 (illustrated in FIGS. 15-18). In the illustrated embodiment, for example, the actuator 400 comprises a single pair of piston shafts 406*a*, 406*b*, each comprising an end extending through respective ends of the cylinder 404. The ends of the cylinder 404 are further enclosed with end caps 214*a*, 214*b*. In order to keep the volume of hydraulic fluid required within the actuator 400 system fixed, shafts of the same diameter may be employed on both ends of the cylinder 404. Alternatively, an expansion tank can be used on each end to supply the required fluid. It should be noted that, in order to keep the actuator 400 system from exceeding a safe operating pressure, hydraulic overpressure valves (not shown) may also be included and can be employed to connect the two fluid reservoirs in both flow directions. The actuator 400 may further include o-rings or lip seals that may be used to seal the cylinder 404 and corresponding endcaps 414*a*, 414*b*, thereby ensuring hydraulic fluid does not escape through apertures through which the piston shafts 406*a*, 406*b* extend. In some embodiments, a metal sealing surface exists between the cylinder 404 and each of the end caps 414*a*, 414*b*. The metal sealing surface is precisely machined to make a metal to metal static seal to keep the hydraulic fluid within the cylinder.

The cylinder 404 further includes a rotor 420 positioned within and a rotary vane pump 408 operably coupled to the rotor 420, operation of which will be described in greater detail herein. As shown, the actuator 400 further includes an external guide assembly 410 operably coupled to the stator 402 and rotor 420 and configured to cause the stator 400 and rotor 420 (and rotary vane pump 408) to move concurrently with the one another along a longitudinal axis of a sealed cylinder 404. In particular, the guide assembly 410 includes a stator guide member 412 directly coupled to the stator 402 and a first set of rails 413*a* upon which the stator guide member 412 is supported. The first set of rails 413*a* extend between the end caps 414*a*, 414*b*. As shown, there are approximately four rails 413*a* positioned in four respective corners of square-shaped end caps 414*a*, 414*b*. Accordingly, the actuator may be referred to as a square format linear actuator, as the end caps 414*a*, 414*b*, as well as stator guide member 412 resemble a square shape. The stator guide member 412 includes four corresponding apertures through which the four rails extend to thereby support the stator guide member 412 and allow the stator guide member 412 to slide thereupon. As such, the rails 413 restrict movement of the stator guide member 412, and thus movement of the stator 402, to lateral movement (i.e., sliding) along a length of the cylinder 404 and along the longitudinal axis of the cylinder 404 and actuator 400. The guide assembly 410 further includes a second set of rails 413*b*, wherein each rail 413*b* passes through respective apertures in end cap 414*b*, thereby supporting a portion of the rail 413*b*. Each rail 413*b* further includes a first end directly coupled to the stator guide member 412 and an opposing second end coupled to an external guide plate 415. The piston shaft 406*b* is coupled at one end to the guide plate 415 and coupled to the rotor/pump at an opposing end.

Accordingly, linear movement of the piston shaft 406*b* (as a result of movement of the rotor/pump) applies a direct force upon the guide plate 415 and, in turn causes corresponding linear movement of the stator guide member 412 and stator 402, as the rails 413*b* are directly coupled to the guide plate 415 at one end and the stator guide member 412 at the other end, such that movement of the guide plate 415 forces movement of the rails 413*b* and stator guide member 412. As a result, the guide assembly 410 allows for the stator, rotary vane pump, and rotor to move concurrently with the one another along a longitudinal axis of the cylinder 404 and maintains alignment of such components with one another. The guide rail 413*b*, plate 415, and piston shaft 406*b* arrangement prevents spinning of the pump 408 and shafts 406*a*, 406*b*.

Referring to FIGS. 16-18, the pump 408 is a rotary vane pump. The inclusion of a rotary vane pump, in place of other pumps, simplifies the manufacturing process and further results in a more robust actuator. The rotary vane pump 408 is a positive-displacement pump that includes a cam 416 including a cylinder having an elliptical profile, including a pair of end caps 417*a*, 417*b* on either end, wherein the cam 416 surrounds the rotor 420. The cam 416 includes apertures 419 for receiving pins coupled to the end caps 417*a*, 417*b*, thereby maintaining alignment of the cam 416 and end caps 417*a*, 417*b*. The rotor 420 is made of a magnetic metal, such as iron. The pump 408 further includes rotor blades 422 (vanes) mounted to the rotor 420 and a radially magnetized permanent magnets 424 mounted to the rotor 420. The rotor 420 rotates inside the cam 416 cylinder, which includes an elliptical interior profile 417. The rotor 420 and pump 408 assembly has a length that is less than an overall length of the cylinder 404, such that fluid reservoirs or chambers are formed on either end of the rotor 420 and pump 408 at ends of the cylinder 404.

Accordingly, during operation, the rotor 420 is configured to rotate inside the larger cavities of the pump 408, specifically within the cavities of the cams. While the cam 416 includes an elliptical interior profile 417, the rotor 420 and cam 416 are concentrically arranged relative to one another, thereby providing a "balanced" configuration. The rotor blades 422 (vanes) are allowed to slide into and out of the rotor 420 and seal on all edges, creating vane chambers that do the pumping work. Not shown are springs or a similar mechanism between the rotor blades 422 and the rotor 420 to ensure the blades are always in contact with the elliptical cam 417. The pump 408 further includes input and output ports 418 for fluid flow. On the intake side of the pump 407, the vane chambers are increasing in volume. These increasing-volume vane chambers are filled with fluid sucked in by the vacuum created by the expanding volume of the chamber. Inlet pressure is the pressure from the low pressure side of the actuator. On the discharge side of the pump, the vane chambers are decreasing in volume, forcing fluid out of the pump. The action of the vane drives out the same volume of fluid with each rotation.

The stator 402 is similar to stators used in brushless DC motors (BLDC) and may include copper windings and laminated ferromagnetic cores. Upon rotation of the rotor 420, induced by currents in the stator windings exerting a force on the magnets in the rotor 420, hydraulic fluid is pumped from one reservoir or chamber to the other. This causes a pressure differential between the fluid reservoirs, causing a new force to be exerted on the rotor 420 and pump 408 assembly and causing it to slide towards the low pressure reservoir. This linear motion is the desired outcome of the system. Accordingly, the rotary vane pump 408 is configured to displace hydraulic fluid away from a first end of the cylinder 404 and towards a second opposing end of the cylinder 404 upon rotation of the rotor 420 in a first direction and, upon rotation of the rotor 420 in a second, opposite direction, the rotary vane pump 408 is configured to displace hydraulic fluid away from the second end of the cylinder 404 and towards the first end of the cylinder 404.

For example, upon rotation of the rotor 420 in a first direction, hydraulic fluid is pumped from one reservoir or chamber to the other, thereby converting rotation of the rotor 420 into linear displacement of the fluid, which subsequently causes linear displacement of at least one of the shafts 406*a*, 406*b* in a first direction. Similarly, reversing the rotation of rotor 420 in an opposite direction results in hydraulic fluid pumping to the other reservoir or chamber, thereby causing linear displacement of the shaft(s) in a second, opposite direction. Accordingly, by providing a pump configured to rotate in opposite directions, the shaft is configured to apply force axially in both a push and pull directions.

The pump 408 may be substantially symmetric to allow substantially equal performance in either rotation direction (i.e., pushing or pulling directions). The piston shafts 406*a*, 406*b* can be supported by a variety of types of bearing, including, but not limited to, OILITE (sintered bronze) bearings or ball bearings. The rotor 420 and pump 408 slides within the cylinder 404 on a seal like an o-ring, dividing the cylinder into two separate fluid reservoirs. The output piston shafts 406*a*, 406*b* are generally supported by a bearing and a seal to contain the hydraulic fluid. The pump 408 is integrated into the body of the rotor 420, as shown in the figures.

It should be noted that the rotor 420 of actuator 400 may be configured to rotate by way of a sensorless brushless DC (BLDC) motor via BLDC drive electronics or similar electronics, such as those illustrated in FIG. 5. In some embodiments, the actuator 400 may further include a shaft position sensor configured to sense a linear position of the shaft of the piston and provide a signal to the BLDC drive electronics to allow for closed shaft loop position control via user input or computer-controlled input in a similar manner as previously described herein with reference to FIG. 5.

Figure 19:
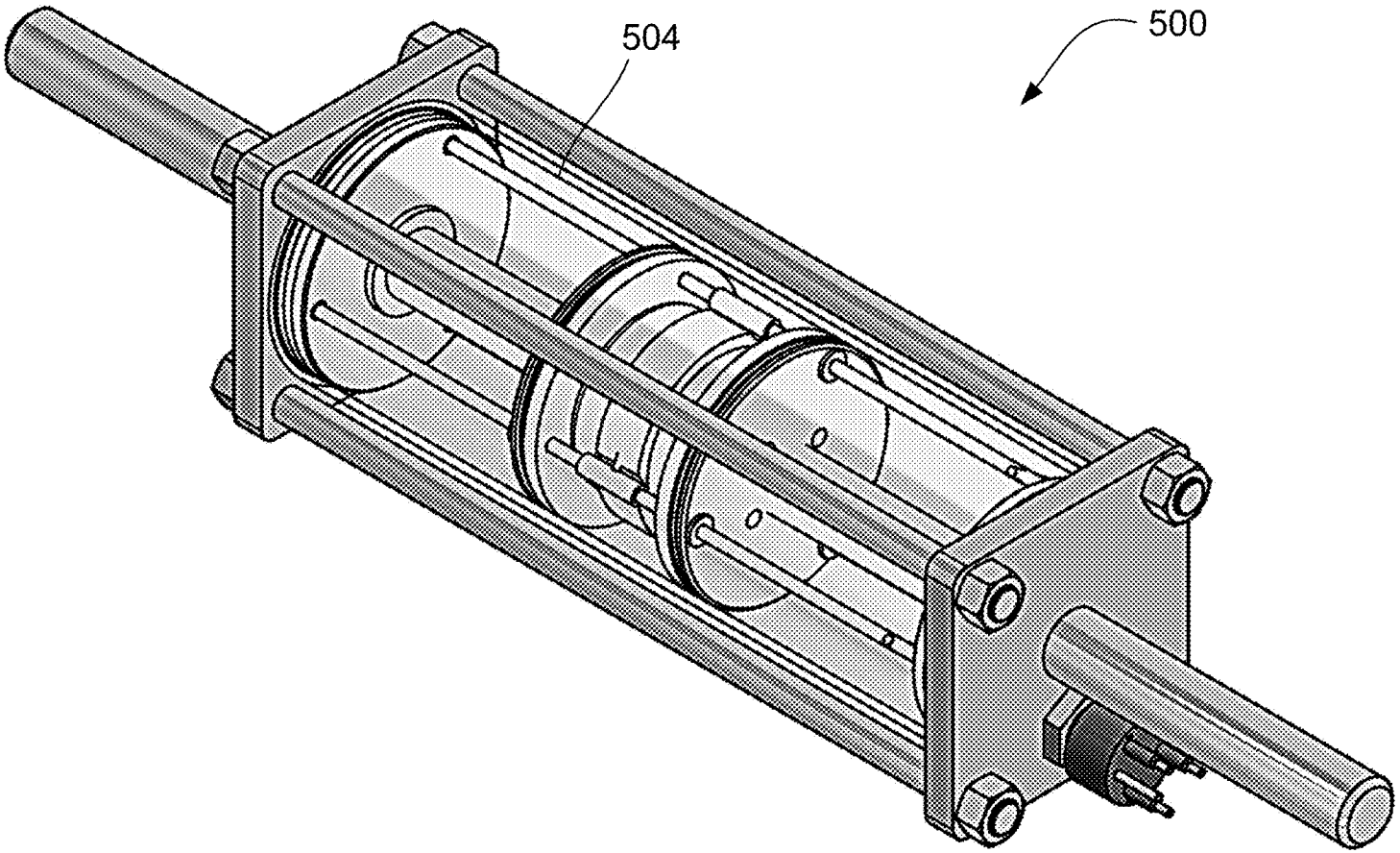
FIG. 19 is a perspective view of another embodiment of a linear actuator consistent with the present disclosure, illustrating a stator positioned within a sealed cylinder, and further including a rotary vane pump and a rotor therein.

FIG. 19 is a perspective view of another embodiment of a linear actuator 500 consistent with the present disclosure. The actuator 500 uses a balanced rotary vane pump (similarly configured as rotary vane pump 408) as the inside what is usually the "piston" of a hydraulic cylinder. The main difference of the design of linear actuator 500 as compared to the other actuator designs described herein is that the magnet winding of the motor (i.e., the stator) is positioned within the interior of the hydraulic cylinder 504, as opposed to positioned on the exterior of the cylinder 504. The operational principle of the actuator 500 is similar as in the previous embodiments of actuators described herein (i.e., the basic premise of pumping of hydraulic fluid from one chamber of the cylinder to the other remains the same). However, by positioning the stator 502 within the interior inside the cylinder 504, no external sliding parts are required, which may be particularly advantageous for some industrial applications in which linear actuators may be exposed to particularly dirty or corrosive environments which sliding parts would be negatively impacted.

Figure 20:
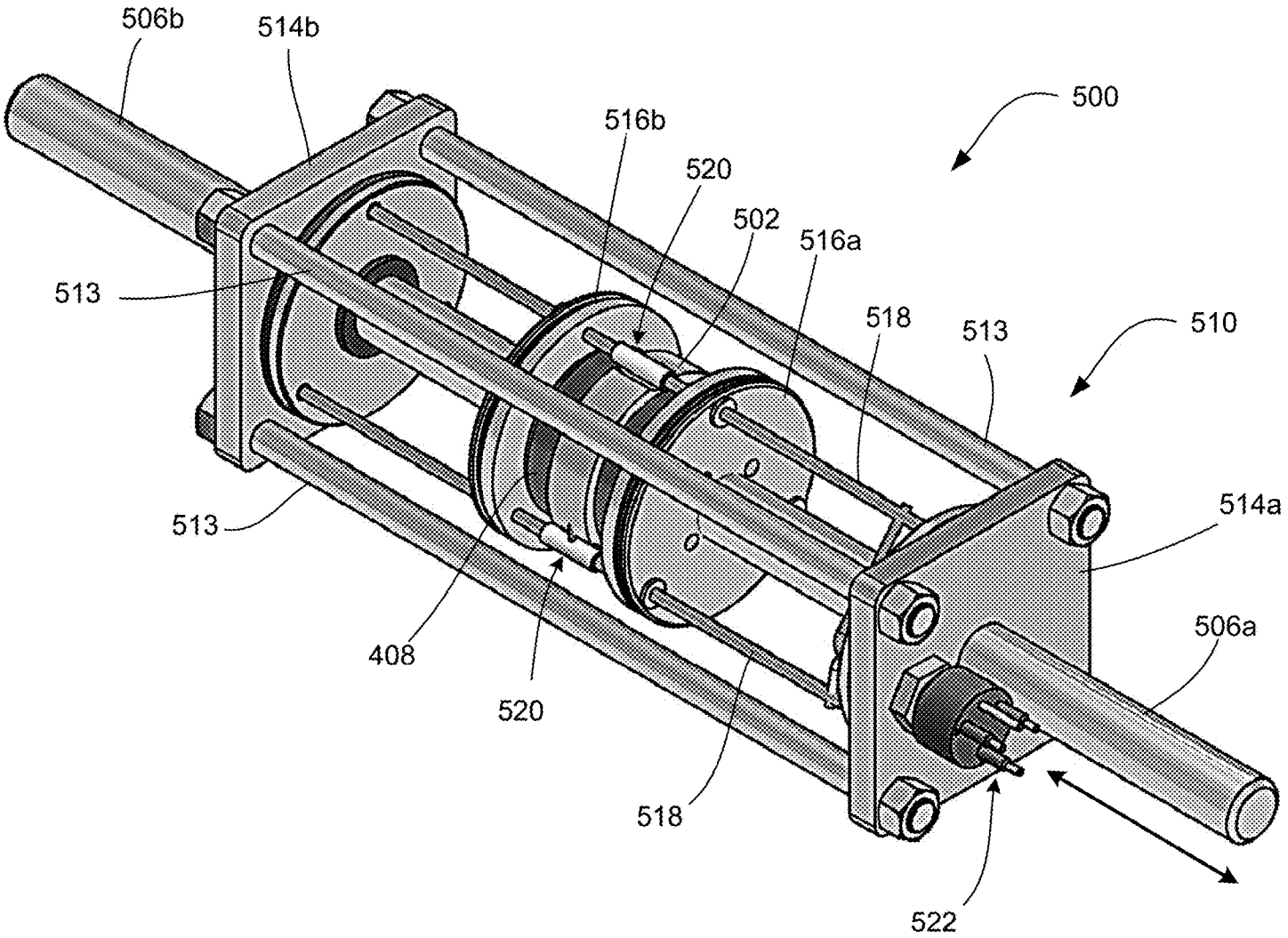
FIG. 20 is a perspective of the linear actuator of FIG. 19 with the cylinder removed to better illustrate the internal components.
Figure 21:
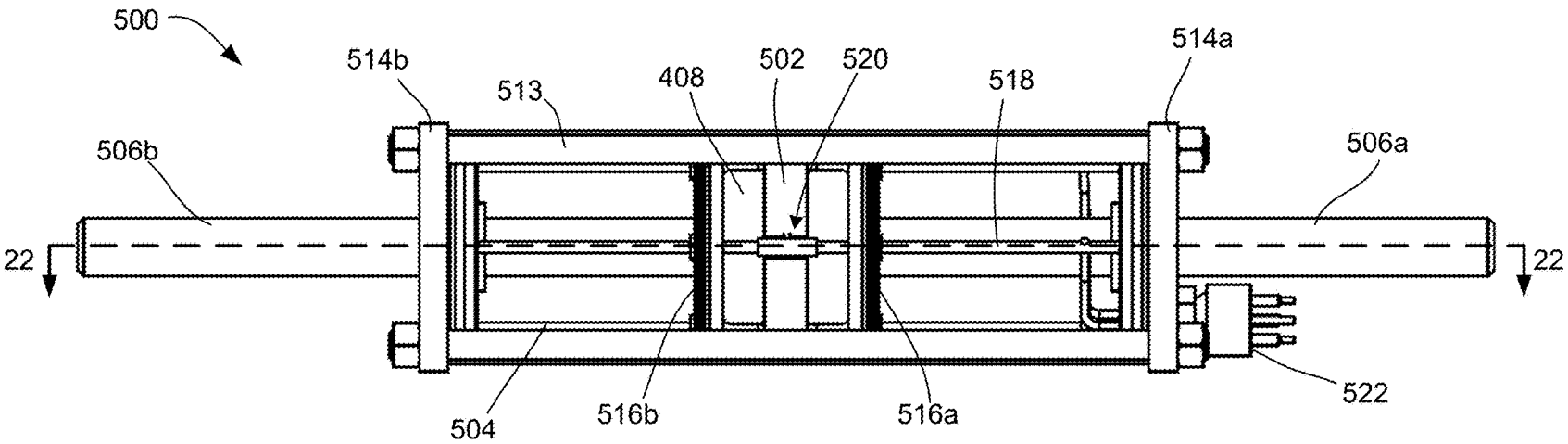
FIG. 21 is a side view of the linear actuator of FIG. 19.
Figure 22:
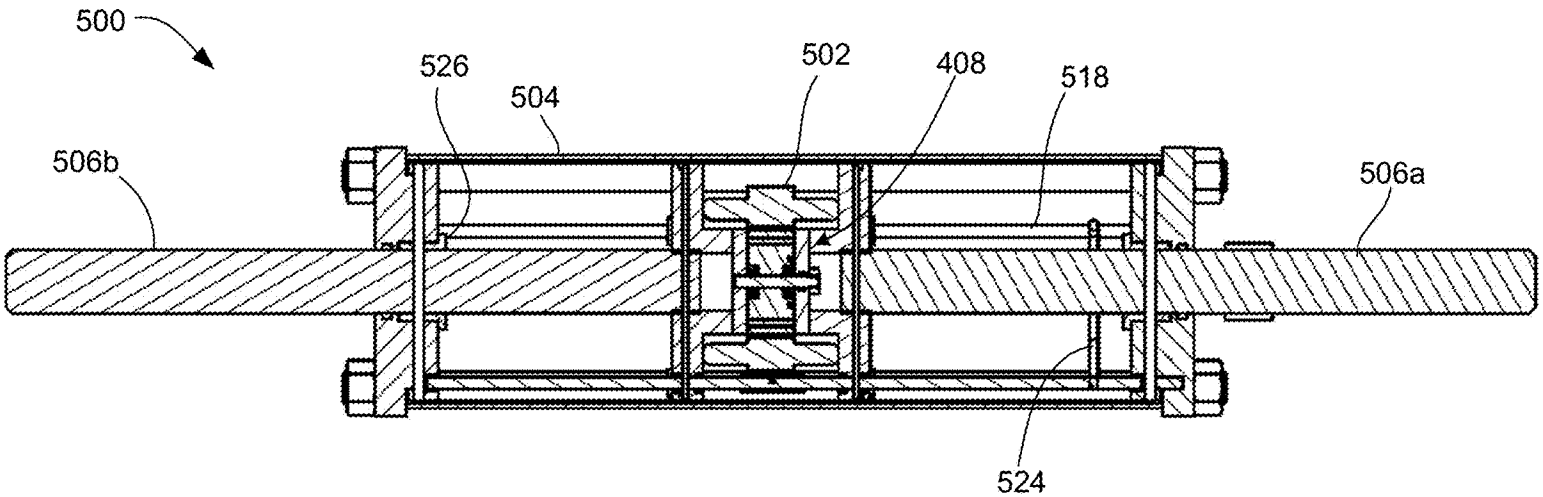
FIG. 22 is a side sectional view of the linear actuator taken along lines 22-22 of FIG. 21.
Figure 23:
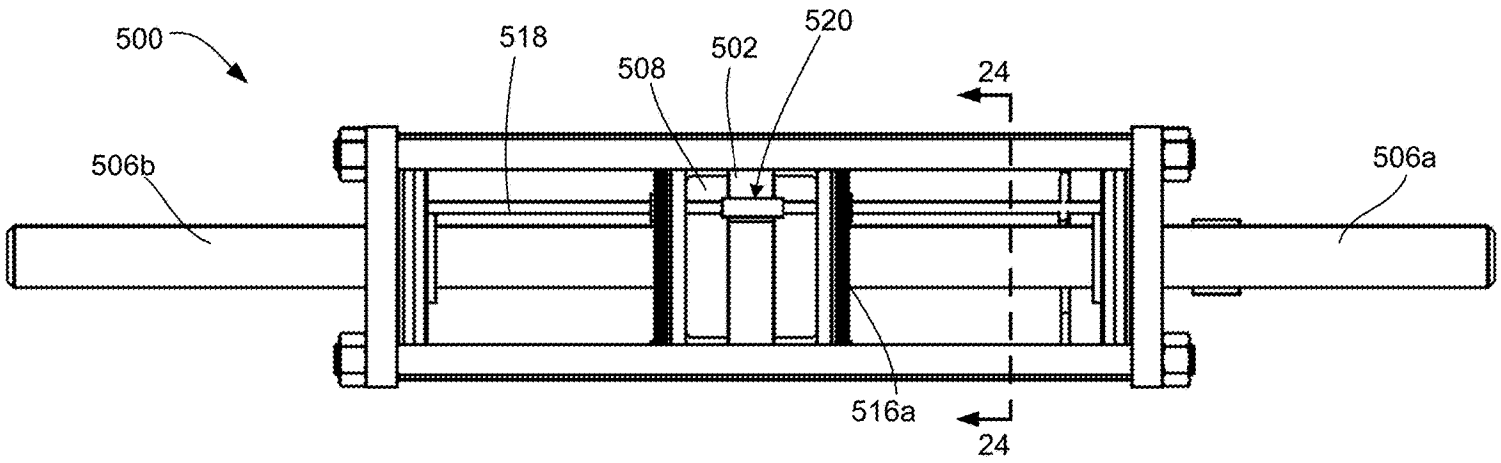
FIG. 23 is a top view of the linear actuator of FIG. 19.
Figure 24:
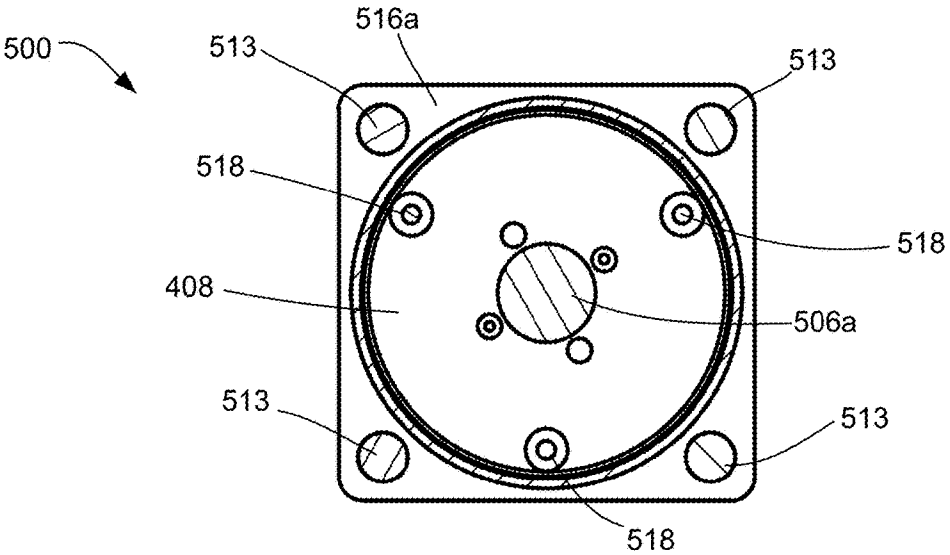
FIG. 24 is a cross-sectional view of the linear actuator taken along lines 24-24 of FIG. 23.

FIG. 20 is a perspective of the linear actuator 500 with the cylinder 504 removed, thereby illustrating the internal components, particularly the stator 502 being positioned within. FIG. 21 is a side view of the linear actuator 500. FIG. 22 is a side sectional view of the linear actuator 500 taken along lines 22-22 of FIG. 21. FIG. 23 is a top view of the linear actuator 500 and FIG. 24 is a cross-sectional view of the linear actuator 500 taken along lines 24-24 of FIG. 23.

As shown, the actuator 500 comprises a stator 502 positioned within the interior of a sealed cylinder member 504 (shown in FIG. 19). The cylinder 504 may be made of a non-ferrous material like titanium, aluminum, or carbon fiber to reduce interference with the movement or operation of any internal components within. The hydraulic fluid could be any incompressible fluid, likely oil or water-based hydraulic fluid. In the illustrated embodiment, the actuator comprises a single coaxial output shaft 506 configured to move (i.e., linear displacement along longitudinal axis of the cylinder 504) upon operation of a drive mechanism of the actuator 500. In the illustrated embodiment, for example, the actuator 500 comprises a single pair of piston shafts 506*a*, 506*b*, each comprising an end extending through respective ends of the cylinder 504. The ends of the cylinder 504 are further enclosed with end caps 514*a*, 514*b*.

In order to keep the volume of hydraulic fluid required within the actuator 500 system fixed, shafts of the same diameter may be employed on both ends of the cylinder 504. Alternatively, an expansion tank can be used on each end to supply the required fluid. It should be noted that, in order to keep the actuator 500 system from exceeding a safe operating pressure, hydraulic overpressure valves (not shown) may also be included and can be employed to connect the two fluid reservoirs in both flow directions. The actuator 500 may further include o-rings or lip seals that may be used to seal the cylinder 504 and corresponding endcaps 514*a*, 514*b*, thereby ensuring hydraulic fluid does not escape through apertures through which the piston shafts 506*a*, 506*b* extend. In some embodiments, a metal sealing surface exists between the cylinder 404 and each of the end caps 514*a*, 514*b*. The metal sealing surface is precisely machined to make a metal to metal static seal to keep the hydraulic fluid within the cylinder.

The actuator 500 further includes a rotor and pump assembly. The rotor and pump assembly is similar to the rotor 420 and rotary vane pump 408 assembly of the actuator 400 previously described herein and operates in the same manner. As shown, the actuator 500 further includes an external structure 510 external to the cylinder 504 and providing structural rigidity to the actuator 500. The external structure 510 includes a set of rails 513 extending between the end caps 514*a*, 514*b*. As shown, there are approximately four rails 513 positioned in four respective corners of square-shaped end caps 514*a*, 514*b*. Accordingly, the actuator may be referred to as a square format linear actuator, as the end caps 514*a*, 514*b* resemble a square shape.

The actuator 500 further includes a piston assembly, which generally consists of the internally positioned stator 502 (which surrounds the rotor and rotary vane pump assembly) and a pair of piston end caps 516*a*, 516*b*. The actuator 500 further includes a set of electrically conductive rails 518 extending between the end caps 514*a*, 514*b*. The electrically conductive rails 518 are composed of an electrically conductive materials, such as brass or copper. Each of the piston end caps 516*a*, 516*b* include corresponding apertures through which the rails 518 extend to thereby support the piston end caps 516*a*, 516*b* and allow the piston end caps 516*a*, 516*b* to slide thereupon, as well as the stator 502 and rotor/pump assembly operably coupled thereto. As such, the rails 518 restrict movement of the piston assembly to lateral movement (i.e., sliding) along a length of the cylinder 504 and along the longitudinal axis of the cylinder 504 and actuator 500. The stator 502 includes carbon brushes 520 coupled thereto which are further configured to slide along the rails 518. As described in greater detail herein, upon receipt of electrical current (from the rails 518), the carbon brushes 520 are configured to deliver current to magnet windings of the stator 502 to thereby drive the rotor for displacement of fluid in the cylinder 504 (via the rotary vane pump) and thereby cause linear displacement of an output shaft 506*a*, 506*b*. The actuator 500 further includes a hermetic connector 522 at an end cap 514*a* through which electrical connections 524 are provided so as to couple the electrically conductive rails 518 to an energy source.

The stator 502 is similar to stators used in brushless DC motors (BLDC) and may include copper windings and laminated ferromagnetic cores. Upon transfer of electrical current from the rails 518 to the carbon brushes 520, current is then passed to the magnet windings in the stator 502. In turn, currents in the stator windings exert a force on the magnets in the rotor, thereby inducing rotation of the rotor. As a result, hydraulic fluid is pumped from one reservoir or chamber to the other. This causes a pressure differential between the fluid reservoirs, causing a new force to be exerted on the rotor and pump assembly and causing it to slide towards the low pressure reservoir. This linear motion is the desired outcome of the system. Accordingly, the rotary vane pump is configured to displace hydraulic fluid away from a first end of the cylinder and towards a second opposing end of the cylinder upon rotation of the rotor in a first direction and, upon rotation of the rotor in a second, opposite direction, the rotary vane pump is configured to displace hydraulic fluid away from the second end of the cylinder and towards the first end of the cylinder.

For example, upon rotation of the rotor in a first direction, hydraulic fluid is pumped from one reservoir or chamber to the other, thereby converting rotation of the rotor into linear displacement of the fluid, which subsequently causes linear displacement of at least one of the shafts 506*a*, 506*b* in a first direction. Similarly, reversing the rotation of rotor in an opposite direction results in hydraulic fluid pumping to the other reservoir or chamber, thereby causing linear displacement of the shaft(s) in a second, opposite direction. Accordingly, by providing a pump configured to rotate in opposite directions, the shaft is configured to apply force axially in both a push and pull directions.

It should be noted that the rotor of actuator 500 may be configured to rotate by way of a sensorless brushless DC (BLDC) motor via BLDC drive electronics or similar electronics, such as those illustrated in FIG. 5. In some embodiments, the actuator 500 may further include a shaft position sensor configured to sense a linear position of the shaft of the piston and provide a signal to the BLDC drive electronics to allow for closed shaft loop position control via user input or computer-controlled input in a similar manner as previously described herein with reference to FIG. 5.

The actuator of the present invention combines the benefits of hydraulic cylinders and electric actuators without many of the drawbacks. In particular, the actuator of the present disclosure provides the power density and robustness of a hydraulic actuator without requiring the extensive plumbing and external pumps generally required in a hydraulic actuator system. Furthermore, the actuator of the present disclosure allows for a small size, quiet operation, and electric-only requirement of an electric actuator without requiring the complex gear trains and potential failure associated with typical components (ball screw, nuts, and gears) of an electric actuator.

As used in any embodiment herein, the term "module" may refer to software, firmware and/or circuitry configured to perform any of the aforementioned operations. Software may be embodied as a software package, code, instructions, instruction sets and/or data recorded on non-transitory computer readable storage medium. Firmware may be embodied as code, instructions or instruction sets and/or data that are hard-coded (e.g., nonvolatile) in memory devices. "Circuitry", as used in any embodiment herein, may comprise, for example, singly or in any combination, hardwired circuitry, programmable circuitry such as computer processors comprising one or more individual instruction processing cores, state machine circuitry, and/or firmware that stores instructions executed by programmable circuitry. The modules may, collectively or individually, be embodied as circuitry that forms part of a larger system, for example, an integrated circuit (IC), system on-chip (SoC), desktop computers, laptop computers, tablet computers, servers, smart phones, etc.

Any of the operations described herein may be implemented in a system that includes one or more storage mediums having stored thereon, individually or in combination, instructions that when executed by one or more processors perform the methods. Here, the processor may include, for example, a server CPU, a mobile device CPU, and/or other programmable circuitry.

Also, it is intended that operations described herein may be distributed across a plurality of physical devices, such as processing structures at more than one different physical location. The storage medium may include any type of tangible medium, for example, any type of disk including hard disks, floppy disks, optical disks, compact disk read-only memories (CD-ROMs), compact disk rewritables (CD-RWs), and magneto-optical disks, semiconductor devices such as read-only memories (ROMs), random access memories (RAMs) such as dynamic and static RAMs, erasable programmable read-only memories (EPROMs), electrically erasable programmable read-only memories (EEPROMs), flash memories, Solid State Disks (SSDs), magnetic or optical cards, or any type of media suitable for storing electronic instructions. Other embodiments may be implemented as software modules executed by a programmable control device. The storage medium may be non-transitory.

As described herein, various embodiments may be implemented using hardware elements, software elements, or any combination thereof. Examples of hardware elements may include processors, microprocessors, circuits, circuit elements (e.g., transistors, resistors, capacitors, inductors, and so forth), integrated circuits, application specific integrated circuits (ASIC), programmable logic devices (PLD), digital signal processors (DSP), field programmable gate array (FPGA), logic gates, registers, semiconductor device, chips, microchips, chip sets, and so forth.

INCORPORATION BY REFERENCE

References and citations to other documents, such as patents, patent applications, patent publications, journals, books, papers, web contents, have been made throughout this disclosure. All such documents are hereby incorporated herein by reference in their entirety for all purposes.

EQUIVALENTS

Various modifications of the invention and many further embodiments thereof, in addition to those shown and described herein, will become apparent to those skilled in the art from the full contents of this document, including references to the scientific and patent literature cited herein. The subject matter herein contains important information, exemplification and guidance that can be adapted to the practice of this invention in its various embodiments and equivalents thereof.

What is claimed is:

1. A linear actuator comprising:

a cylinder comprising an interior volume and containing hydraulic fluid within;

stator positioned coaxially relative to the cylinder;

a rotor positioned within the cylinder, wherein the rotor comprises one or more permanent magnets and is configured to rotate about a longitudinal axis of the cylinder upon activation of the stator;

a pump coupled to the rotor and configured to displace hydraulic fluid away from a first end of the cylinder and towards a second opposing end of the cylinder upon rotation of the rotor;

one or more electrically conductive rails positioned within and extending along a length of the cylinder, each of the electrically conductive rails is configured to deliver electrical current to carbon brushes operably associated with the stator and in turn activate the stator to thereby induce rotation of the rotor; and at least one piston shaft having a first end coupled to the rotor and positioned within the cylinder and a second end extending through an end of the cylinder and positioned external to the interior of the cylinder, wherein operation of the pump causes displacement of the hydraulic fluid and thereby causes linear displacement of the piston shaft along the longitudinal axis of the cylinder based on the displacement of the hydraulic fluid.

2. The linear actuator of claim 1, wherein the cylinder comprises a non-ferrous material.

3. The linear actuator of claim 2, wherein the material comprises titanium, aluminum, or carbon fiber.

4. The linear actuator of claim 1, further comprising end caps enclosing corresponding first and second ends of the cylinder.

5. The linear actuator of claim 4, further comprising o-rings or lip seals positioned between the end caps and corresponding first and second ends of the cylinder.

6. The linear actuator of claim 1, wherein the first end of the piston shaft is coupled to the rotor by way of thrust bearings allowing for linear translation of the piston shaft without rotation of the piston shaft in response to rotation of the rotor.

7. The linear actuator of claim 1, wherein the pump comprises:

a first gear configured to engage and be driven by one or more internal gears of the rotor upon rotation of the rotor; and a second gear engaged with the first gear.

8. The linear actuator of claim 7, wherein, upon rotation of the rotor and subsequent meshing of the first and second pump gears in a first rotational direction, the pump is configured to draw hydraulic fluid away from a first end of the cylinder and towards a second opposing end of the cylinder and upon rotation of the rotor and subsequent meshing of the first and second pump gears in a second rotational direction opposite the first rotational direction, the pump is configured to draw hydraulic fluid away from the second end of the cylinder and towards the first end of the cylinder.

9. The linear actuator of claim 1, wherein the pump is selected from the group consisting of a spur gear pump, a piston pump, and a rotary vane pump.

10. The linear actuator of claim 1, wherein the cylinder comprises an integrated expansion reservoir to accommodate effects as a result of operation of the actuator.

11. The linear actuator of claim 10, wherein the effects comprises thermal expansion and hydraulic fluid displacement operation.

12. The linear actuator of claim 1, wherein the piston shaft is supported within a portion of the cylinder by a bearing.

13. The linear actuator of claim 12, wherein the bearing comprises a sintered bronze bearing ball bearing.

14. The linear actuator of claim 12, wherein the bearing is positioned in an end cap enclosing a corresponding end of the cylinder.

15. The linear actuator of claim 1, wherein operation of the stator is based on input from a brushless DC (BLDC) drive electronics controller associated with a sensorless BLDC motor.

16. The linear actuator of claim 1, further comprising a shaft position sensor configured to sense a position of the piston shaft and transmit a signal to a controller coupled to the actuator.

17. The linear actuator of claim 16, wherein the controller comprises a brushless DC (BLDC) drive electronics controller and a microprocessor.

18. The linear actuator of claim 17, wherein at least one of the BLDC drive electronics controller and microprocessor is configured to output a linear position of the piston shaft based on the signal from the shaft position sensor.

19. The linear actuator of claim 18, wherein at least one of the BLDC drive electronics controller and microprocessor is configured provide a user with control over the piston shaft position.

20. The linear actuator of claim 1, wherein the stator and rotor are configured to correspondingly translate along the longitudinal axis of the cylinder such that the stator and rotor remain in coaxial alignment with one another during operation of the pump.

21. The linear actuator of claim 20, wherein the stator has a length that is less than a length of the cylinder.

22. The linear actuator of claim 1, wherein the stator is positioned within the cylinder.

23. A linear actuator comprising:

a cylinder comprising an interior volume and containing hydraulic fluid within;

stator positioned coaxially relative to the cylinder and positioned on an exterior of the cylinder;

a rotor positioned within the cylinder, wherein the rotor comprises one or more permanent magnets and is configured to rotate about a longitudinal axis of the cylinder upon activation of the stator;

a pump coupled to the rotor and configured to displace hydraulic fluid away from a first end of the cylinder and towards a second opposing end of the cylinder upon rotation of the rotor;

at least one piston shaft having a first end coupled to the rotor and positioned within the cylinder and a second end extending through an end of the cylinder and positioned external to the interior of the cylinder, wherein operation of the pump causes displacement of the hydraulic fluid and thereby causes linear displacement of the piston shaft along the longitudinal axis of the cylinder based on the displacement of the hydraulic fluid.

* * * * *